US008319455B2

(12) United States Patent
Bennette

(10) Patent No.: US 8,319,455 B2
(45) Date of Patent: Nov. 27, 2012

(54) COLORIZER AND METHOD OF OPERATING THE SAME

(75) Inventor: Adam Bennette, London (GB)

(73) Assignee: Electronic Theatre Controls, Inc., Middleton, WI (US)

( * ) Notice: Subject to any disclaimer, the term of this patent is extended or adjusted under 35 U.S.C. 154(b) by 316 days.

(21) Appl. No.: 12/655,046

(22) Filed: Dec. 22, 2009

(65) Prior Publication Data

US 2010/0171444 A1 Jul. 8, 2010

Related U.S. Application Data

(60) Provisional application No. 61/143,205, filed on Jan. 8, 2009.

(51) Int. Cl.
*G09G 5/10* (2006.01)

(52) U.S. Cl. ..... 315/312; 315/291; 315/210; 315/149; 345/22; 345/72; 345/83; 345/88; 345/690

(58) Field of Classification Search ..... 315/312, 315/297, 291, 210, 209 R, 152, 149, 150; 362/231; 345/589, 604, 690, 22, 72, 83, 345/88, 431, 593, 597
See application file for complete search history.

(56) References Cited

U.S. PATENT DOCUMENTS

| | | | |
|---|---|---|---|
| 4,602,321 | A | 7/1986 | Bornhorst |
| 4,894,760 | A | 1/1990 | Callahan |
| 4,914,556 | A | 4/1990 | Richardson |
| 5,031,078 | A | 7/1991 | Bornhorst |
| 6,132,072 | A | 10/2000 | Turnbull et al. |
| 6,236,406 | B1 | 5/2001 | Li |
| 6,241,362 | B1 | 6/2001 | Morrison |
| 6,252,638 | B1 | 6/2001 | Johnson et al. |
| 6,886,964 | B2 | 5/2005 | Gardiner et al. |
| 7,264,367 | B2 | 9/2007 | Hulse |

(Continued)

FOREIGN PATENT DOCUMENTS

WO 2008068713 6/2008

OTHER PUBLICATIONS

International Search Report and Written Opinion for Application No. PCT/US2009/069199 dated Nov. 26, 2010 (10 pages).

*Primary Examiner* — Douglas W Owens
*Assistant Examiner* — Jonathan Cooper
(74) *Attorney, Agent, or Firm* — Michael Best & Friedrich LLP

(57) ABSTRACT

Systems and methods for controlling the output of a plurality of light sources. The system can include four or more light sources (e.g. light emitting diodes ("LEDs")) and a controller. The light sources are included in, for example, a luminaire. The respective outputs of the plurality of light sources are controlled using a hue and purity ("HP") control technique. The HP technique includes selecting a dominant hue (e.g., green, blue, red, etc.). The purity of the selected hue is then modified to include or remove wavelengths of light adjacent to the selected hue. For example, if the selected hue is green, gradually reducing the purity of the selected hue gradually increases the presence of cyan and amber in the output of the luminaire. As the purity is reduced further, additional wavelengths of light are included, but the output of the luminaire remains, in essence, green.

21 Claims, 43 Drawing Sheets

U.S. PATENT DOCUMENTS

| | | | | |
|---|---|---|---|---|
| 7,524,097 | B2 | 4/2009 | Turnbull et al. | |
| 2004/0158300 | A1 | 8/2004 | Gardiner | |
| 2006/0268558 | A1 | 11/2006 | Calmes | |
| 2007/0126933 | A1 | 6/2007 | Ting | |
| 2008/0055896 | A1 | 3/2008 | Feldmeier | |
| 2008/0186322 | A1 | 8/2008 | Polak et al. | |
| 2008/0204268 | A1* | 8/2008 | Dowling et al. | 340/815.45 |
| 2009/0027881 | A1 | 1/2009 | Belliveau et al. | |
| 2009/0121992 | A1 | 5/2009 | Asao et al. | |
| 2010/0219760 | A1* | 9/2010 | Tanaka et al. | 315/152 |

* cited by examiner

COLORIZER AND METHOD OF OPERATING THE SAME

RELATED APPLICATIONS

This application claims the benefit of previously filed, U.S. Provisional Patent Application No. 61/143,205, filed Jan. 8, 2009, the entire content of which is hereby incorporated by reference.

FIELD OF THE INVENTION

This invention relates to systems and methods for controlling the color output of luminaires.

BACKGROUND

Isaac Newton devised a diagram showing the visible spectrum as a circle in his work *Opticks* published in 1704. Newton's color circle 10 is illustrated in FIG. 1. Although Newton did not make note of the discontinuity between the colors red and violet, the diagram 10 is a useful tool for illustrating the manner in which colors mix. For example, color points can be synthesized by drawing lines between available colors on the diagram 10 and altering their proportions.

The ability of the human eye to sense colors, and the ability of the human brain ability to perceive colors, are dependent upon the wavelength of the light. The human eye is sensitive to light in the spectrum of wavelengths from approximately 390 nm (i.e., violet) to approximately 700 nm (i.e., red), as illustrated in diagram 15 of FIG. 2. Color perception by the human brain with respect to wavelength is illustrated in diagram 20 FIG. 3, although color perception and the ability to detect the extreme ends of the visual spectrum vary from individual to individual. For example, for low levels of light, the visual spectrum of wavelengths can extend further into the ultra violet ("UV") range as rod detectors in the human eye, which have a more significant response to UV light, dominate color perception.

With the exception of partial UV and very low levels of black-and-white vision produced by the eye's rod detectors, primary color perception is produced by three types of cone detectors which detect broad bands of color in the red, green, and blue wavelengths (see FIG. 3). The cone detectors produce signals (e.g. pulse signals) proportional to the number of photons arriving on the each of the cone detectors having wavelengths within their sensitivity range.

The human brain interprets the rate at which the cone detectors produce pulse signals to create the perception of a color. The human brain is also capable of perceiving colors with wavelengths of light outside of the simple color spectrum. For example, colors such as lavender, pink, and magenta are not spectral colors, and can only be made by the mixing different spectral colors (e.g., red and blue). Wavelengths of light which fall in between the peak responses of the cone detectors, such as yellow-green, cyan, and magenta are perceived according to the relative proportion of signals from the red and green pair of cone detectors, the green and blue pair of cone detectors, and the blue and red pair of cone detectors, respectively.

Such a process allows the human brain to perceive a large number of apparent colors being output from a luminaire with a small number of light sources (e.g., three light sources). In a similar manner, it is possible to fill in the color gaps of a practical luminaire by spectrally positioning the light sources on either side of these color gaps. For example, a yellow color gap can be filled by mixing red, amber, and green in suitable proportions.

The light sources in luminaires typically use devices or emitters which produce narrow-band electrochemical emissions, such as light-emitting diodes ("LEDs"), organic light-emitting diodes ("OLEDs"), fluorescent sources, or other similar devices. Such light sources are generally only available in a limited variety of colors, and between these colors, there are parts of the visible spectrum that have no emitters available. For example, using current technology, yellow and yellow/green (i.e., wavelengths from 550-580 nm) are difficult to produce. As a result of gaps which appear in the visual spectrum where there is no substantial light emission, a practical color mixing luminaire offers control over some but not all parts of the visible spectrum, because. Additionally, the emitters at the limits of the visible spectrum typically have a lower lumen output (e.g., perceived power), are less efficient, and are more expensive to produce.

Practical emitters also suffer from variations in spectral bandwidth, absolute luminosity, and dominant wavelength. As such, manufacturers batch-sort or bin emitters into moderately wide ranges. Although batch sorting into narrow, precise ranges is technically feasible, it is unreasonably expensive. For example, current LED technology provides up to approximately nine colors having the characteristics shown below in Table 1, although violet and extreme red are uncommon, expensive, and perform relatively poorly in comparison to the other colors.

TABLE 1

LED LIGHT SOURCES

| HUE | WAVELENGTH (nm) | HALF-WIDTH (nm) | BINNING RANGE (nm) |
|---|---|---|---|
| Violet | 410 | 25 | 390-420 |
| Royal Blue | 450 | 20 | 440-460 |
| Blue | 470 | 25 | 460-490 |
| Cyan | 505 | 30 | 490-520 |
| Green | 530 | 35 | 520-550 |
| Amber | 590 | 14 | 585-600 |
| Red/Amber | 615 | 20 | 610-620 |
| Red | 630 | 20 | 620-645 |
| Extreme Red | 660+ | 20 | No data |

Luminaires which incorporate multiple light sources are also typically controlled using one or more of three basic techniques. The first technique provides simple controls for the individual color sources such that a user is able to alter the intensity of each component color from zero to full-scale using a separate control. Typically, a linear or rotary fader or dial is used for this control. Alternatively, a numerical intensity value for each individual color is entered by the user. Such a technique is cumbersome and difficult because a user must have at least a working knowledge of color theory to obtain a desired final color when independently manipulating several sources.

The second technique provides control of the hue, saturation, and intensity ("HSI") using three of the above described controls or using a graphical map of the visual color space. This technique allows the user to pick a color represented by the color space between three points (i.e. within the triangle formed by the points of the primary colors red, green, and blue, or alternatively, the secondary colors cyan, magenta and yellow), and vary the saturation and intensity of that color.

The third technique provides commonly named or numbered colors, which correspond to lighting filters (e.g., gels)

used in theatre or television lighting. The user selects a name or number of a color, and the color is identified in a table which includes the component color values necessary to produce the selected color.

Each of the above techniques is based on the use of three base colors from which all other colors are subsequently generated. Such techniques are commonly used in cathode ray tube ("CRT") displays, flat panel displays, and variable color luminaires which use either primary emissive sources (e.g., LEDs) or secondary filtered sources (e.g., gels).

SUMMARY

The color mixing techniques described above have been employed extensively. However, each of the three techniques is deficient for at least three reasons: (1) each is unable to properly represent all of the colors in the visible spectrum because the spectrum of colors capable of being sensed by the human eye is not arranged as a triangle with flat sides (e.g., with points at the primary colors). Instead, the spectrum of colors capable of being sensed by the human eye is more accurately illustrated as a triangle connected by lobes. These lobes cannot be adequately produced using only three color sources; (2) metamerism causes colors produced using three color systems to be distorted when viewed on objects or surfaces which are not white; and (3) real-world colors are complex mixtures of light having varying proportions of different wavelengths from the entire gamut of the visible spectrum. A system which is only able to select a single dominant color and vary a degree of saturation to white is unable to accurately represent all of the colors which can be sensed by the human eye and perceived by the human brain.

To remedy these deficiencies, additional monochromatic light sources have been developed which correspond to the spectral wavelengths in between the primary red, green, and blue ("RGB") wavelengths. The additional light sources allow for the generation of a wider gamut and more continuous spectrum or colors. However, individually controlling each of the light sources results in a complex set of interactions which render the generation of a desired output color difficult or impossible.

Embodiments of the invention provide a system and method for controlling the output of a plurality of light sources. A luminaire that includes four or more light sources (e.g. light emitting diodes ("LEDs")) cannot be easily controlled using the above-described control techniques. Accordingly, the luminaire is controlled by modifying a hue and purity of the hue. Such a technique includes selecting a dominant luminaire output hue (e.g., green, blue, red, etc.). The purity of the selected hue is modified to include additional wavelengths of light which are adjacent to the selected hue. For example, if the selected hue is green, gradually reducing the purity of the selected hue gradually increases the presence of cyan and amber in the output of the luminaire. As the purity is reduced further, additional wavelengths of light are included, but the output of the luminaire remains, in essence, green. Additional controls, such as colorize, tint, and intensity control, are also used to further enhance the control of the output of the luminaire.

In one embodiment, the invention provides a system for controlling an output of one or more luminaires. The system includes a plurality of light sources and a controller. The light sources are electrically coupled to the one or more luminaires, and are configured to generate a color output of the system. For example, the light sources can be an array of light sources which are included in one of the one or more luminaires (e.g., the light sources are internal to the one or more luminaires). As another example, the light sources can be external to the one or more luminaires but connected (e.g., via a wire or cable) to the one or more luminaires. Each of the plurality of light sources has an output intensity value. The controller is connected to the plurality of light sources, and is configured to select a first hue related to a first range of wavelengths of light. The first hue also corresponds to an output intensity value for at least one of the plurality of light sources. The controller is also configured to modify a purity of the first hue to modify the wavelengths of light included in the first range of wavelengths, and control the color output of the system based at least in part on the selected first hue and the purity of the first hue. Modifying the purity of the first hue modifies an output intensity value of one or more of the plurality of light sources.

In another embodiment, the invention provides a method of controlling an output of one or more luminaires, which each include a plurality of light sources. The method includes generating a color output, associating an output intensity value with each of the plurality of light sources, and selecting a first hue related to a first range of wavelengths of light. The first hue corresponds to an output intensity value for at least one of the plurality of light sources. The method also includes modifying a purity of the first hue to modify the wavelengths of light included in the first range of wavelengths. Modifying the purity of the first hue modifies an output intensity value of one or more of the plurality of light sources, and the color output.

In yet another embodiment, the invention provides a control set for controlling an output of one or more color sources, each of which has an output intensity value. The control set includes a first output control device and a second output control device. The first output control device is configured to select a first hue related to a first range of wavelengths in the visual spectrum. The selected first hue corresponds to an output intensity value for at least one of the plurality of color sources. The second output control device is configured to modify a purity of the first hue to control the wavelengths of light included in the first range of wavelengths. The second output control device modifies an output intensity value of one or more of the plurality of color sources.

Other aspects of the invention will become apparent by consideration of the detailed description and accompanying drawings.

DETAILED DESCRIPTION

Figure 1:
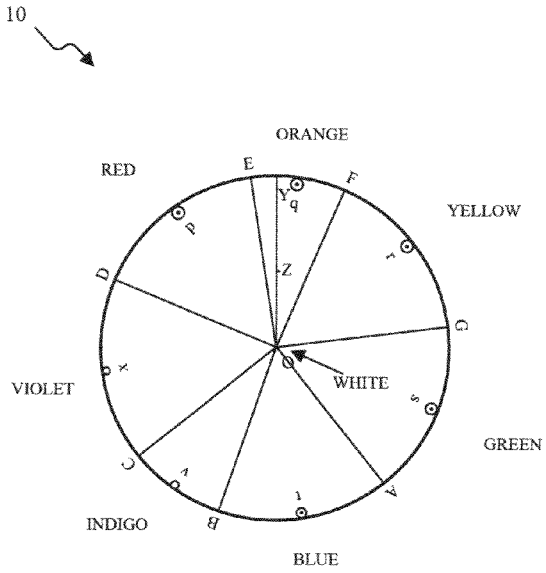
FIG. 1 illustrates Newton's color circle.
Figure 2:
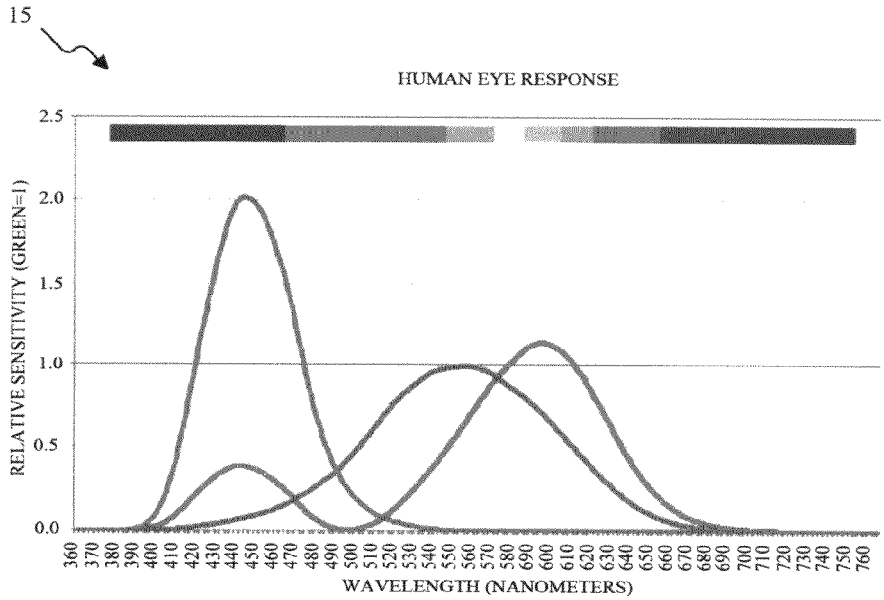
FIG. 2 illustrates of human eye response to various wavelengths of light.
Figure 3:
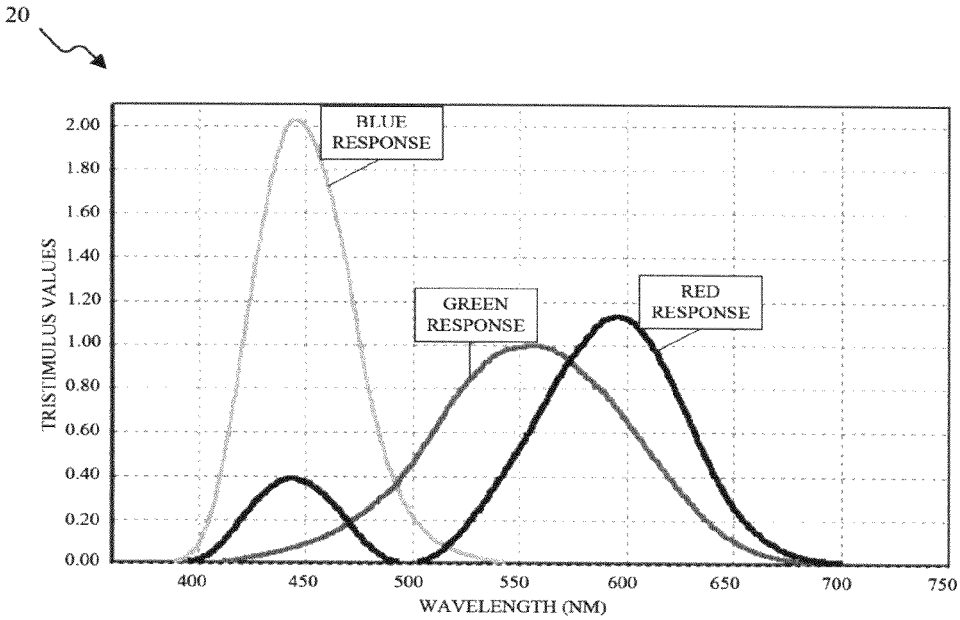
FIG. 3 illustrates of human color perception for various wavelengths of light.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Embodiments of the invention described herein relate to a system and method for controlling the output of a plurality of light sources. For example, a luminaire that includes four or more light sources (e.g. light emitting diodes ("LEDs")) cannot easily be controlled using the previously described conventional control techniques. Instead, the luminaire is controlled using a hue and purity ("HP") technique according to at least some embodiments of the invention. The HP technique includes selecting a dominant luminaire output hue (e.g., green, blue, red, etc.). The purity of the selected hue is modified to include or remove wavelengths of light adjacent to the selected hue. For example, if the selected hue is green, gradually reducing the purity of the selected hue gradually increases the presence of cyan and amber in the output of the luminaire. As the purity is reduced further, additional wavelengths of light are included, but the output of the luminaire remains, in essence, green. The HP technique is supplemented by additional controls, such as saturation, colorize, tint, and intensity. Colorization and tinting allow for the addition and control of secondary hues to the selected primary hue. Such a method of control is readily applicable to a lighting system, a luminaire, or a color production system which includes, for example, four or more monochromatic light sources, or subtractive systems which include various light filters or gels.

Various embodiments of the invention are implemented in a system 100 of one or more luminaires for use in, for example, a theatre, a hall, an auditorium, a studio, or the like. In other embodiments, the invention is applied to digital color generating systems for generating colors using, for example, a computer, a color reproduction device, or a color simulation device. Each luminaire includes, among other things, a housing, a plurality of light sources, a reflector, a lens, a ballast, and a controller 105. In one embodiment, each luminaire includes seven light sources or emitters. Each light source is configured to generate light at a specific wavelength or range of wavelengths. For example, the emitters are capable of generating light corresponding to the colors super-red, red-amber, amber, green, cyan, blue, and royal blue. In some embodiments, emitters that generate different colors are used. In other embodiments, filtered light sources are used in place of the emitters.

In one embodiment, the controller 105 is included in a luminaire. However, in some embodiments, the controller is included in an external device (e.g., a computer) that is connected to the one or more luminaires, and is used to control the one or more luminaires. Alternatively, in some embodiments, the controller 105 is included in a luminaire but connected through a communication module to an external device (e.g., a computer) which includes a processor, memory module, input/output module, and controls the light sources and displays of system or luminaires. In other embodiments, the system includes a plurality of controllers which are each configured to control at least a portion of the system (e.g., one or more luminaires) or at least one feature of the system.

Figure 4:
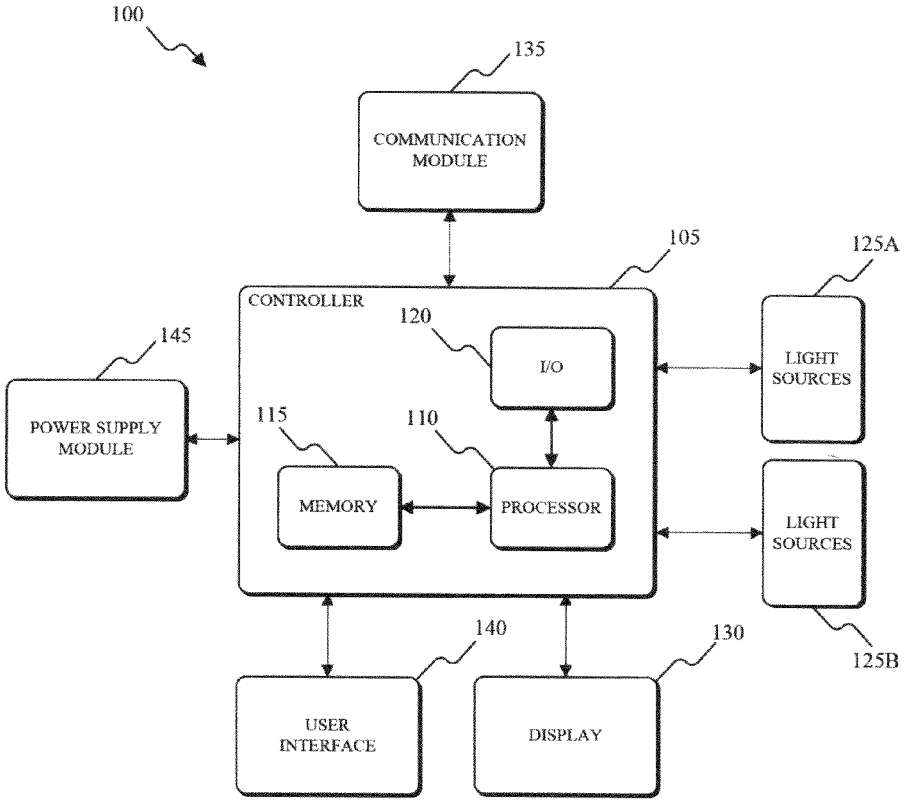
FIG. 4 illustrates a lighting system according to one embodiment of the invention.

As illustrated in FIG. 4, the controller 105 includes a processor 110, a memory module 115, and an input/output module 120. The controller 105 also includes software and hardware that is operable to, among other things, control the operation of one or more of the luminaires, control the output of each of the light sources 125A and 125B, and activate one or more indicators in a display 130 (e.g., LEDs or a liquid crystal display ("LCD")). In the illustrated embodiment, the light sources 125A and 125B are groups of light sources associated with, for example, first and second luminaires. Additionally or alternatively, each luminaire can include multiple groups of light sources.

In one embodiment, the controller 105 also includes a printed circuit board ("PCB") (not shown) that is populated with a plurality of electrical and electronic components which provide, power, operational control, and protection to the system or luminaires. In some embodiments, the PCB includes a processing unit such as the processor 110 (e.g., a microprocessor, a microcontroller, or the like), and connects the processor 110 to, for example, the memory module 115 and the input/output module 120 via one or more busses. The memory module 115 includes, for example, read-only memory ("ROM"), random access memory ("RAM"), electrically-erasable programmable read-only memory ("EEPROM"), or flash memory. The input/output module 120 includes routines for transferring information between components within the controller 105 and other components of the luminaires or system.

The controller 105 is also configured to communicate with other components or subsystems within the system using the busses or the communication module 135. Software included in the implementation of the luminaire is stored in the memory module 115 of the controller 105. The software includes, for example, firmware, one or more applications, program data, one or more program modules, and other executable instructions. The controller 105 is configured to retrieve from memory and execute, among other things, the control processes and methods described below. In other embodiments, the controller 105 or external device includes additional, fewer, or different components.

The PCB also includes, among other things, a plurality of additional passive and active components such as resistors, capacitors, inductors, integrated circuits, and amplifiers. These components are arranged and connected to provide a plurality of electrical functions to the PCB including, among other things, filtering, signal conditioning, and voltage regulation. For descriptive purposes, the PCB and the electrical components populated on the PCB are collectively referred to as "the controller."

Embodiments of a user interface 140 for use in the system are described below. The user interface 140 is configured to control a light output, the output of the luminaires, or the operation of the system as a whole. For example, the user interface 140 is operably coupled to the controller 105 to control the output of each individual light source. The user interface 140 can include any combination of digital and analog input devices required to achieve a desired level of control for the system. For example, the user interface 140 can include a computer having a display and input devices, a touch-screen display, a plurality of knobs, a plurality of dials, a plurality of switches, a plurality of buttons, or the like.

A power supply module 145 supplies a nominal AC or DC voltage to the luminaires or system. The power supply module 145 is powered by mains power having nominal line voltages between, for example, 100V and 240V AC and frequencies of approximately 50-60 Hz. The power supply module 145 is also configured to supply lower voltages to operate circuits and components within the luminaire. In other embodiments, the luminaire is powered by one or more batteries or battery packs.

Figure 5:
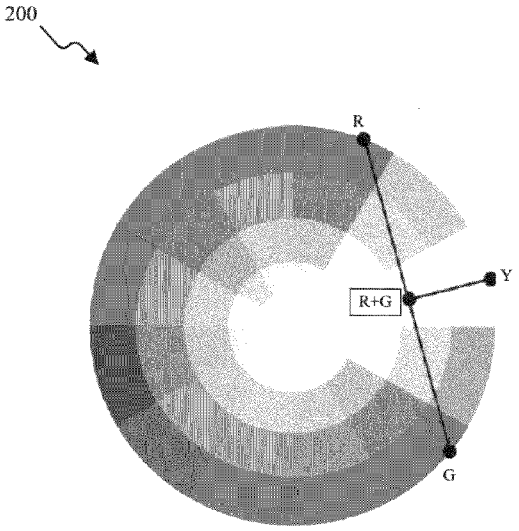
FIG. 5 illustrates a relationship between a synthesized color and a pure spectral color.

The benefits of a system such as that described above are made clear upon examination of a synthesized color and a pure spectral color. For example, FIG. 5 illustrates a color wheel 200 with a selected hue which is centered on yellow, and red, yellow, and green ("RYG") emitters are present. Colors along the line defined by [r+g, y] appear yellow with a gamut which increases from [y] to [y+r+g]. Although such an example is rudimentary, when more light sources are added to provide a more complete representation of the visual spectrum, controlling the gamut of the output of the luminaire becomes increasingly complex.

To offset the complexity of additional (i.e., more than three) light sources, a control set which includes controls for hue, purity, and saturation is provided. The controls are, for example, faders, dials, co-ordinate points selected from a diagram, numbers entered using a keypad, or the like. The control set is described in greater detail below.

FIGS. 6-10 illustrate the conceptual control of the output of a luminaire using the standard colors (i.e., red, orange, yellow, green, blue, indigo, and violet), although practical emitters produce colors having wavelengths which appear between the standard spectral colors. The operation of the controls is independent of the wavelengths of the light sources used.

For descriptive purposes, the primary controls of the control set are generally defined below.

Figure 6:
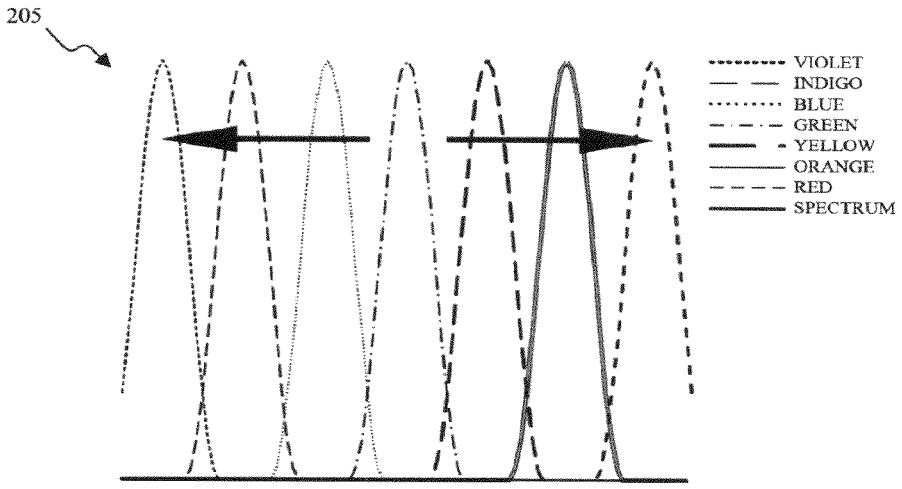
FIG. 6 illustrates the effect of hue control.

Hue or wavelength ("W") is a value which varies a central wavelength around which other controls operate, as shown in diagram 205 of FIG. 6.

Figure 7:
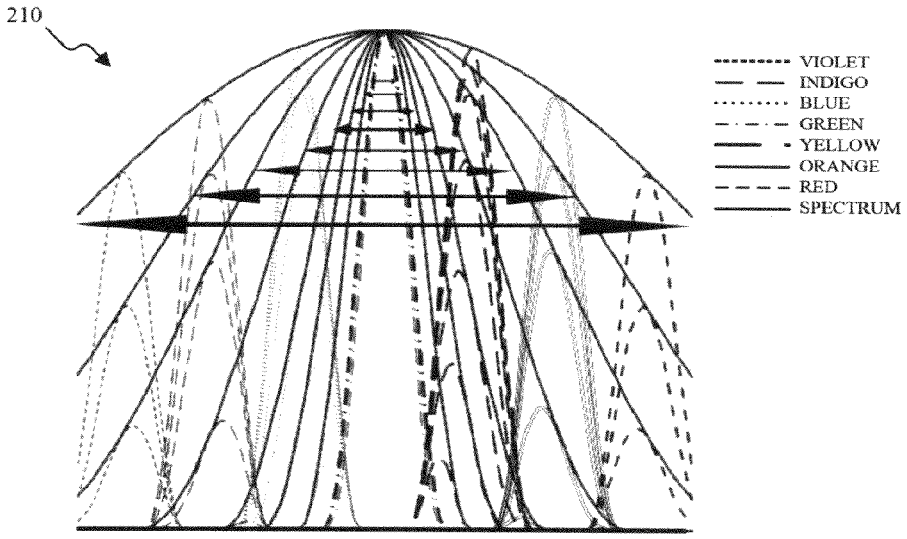
FIG. 7 illustrates the effect of purity control.

Purity ("Q") is a value which varies the width of the spectrum around the selected hue, as shown in diagram 210 of FIG. 7.

Figure 8:
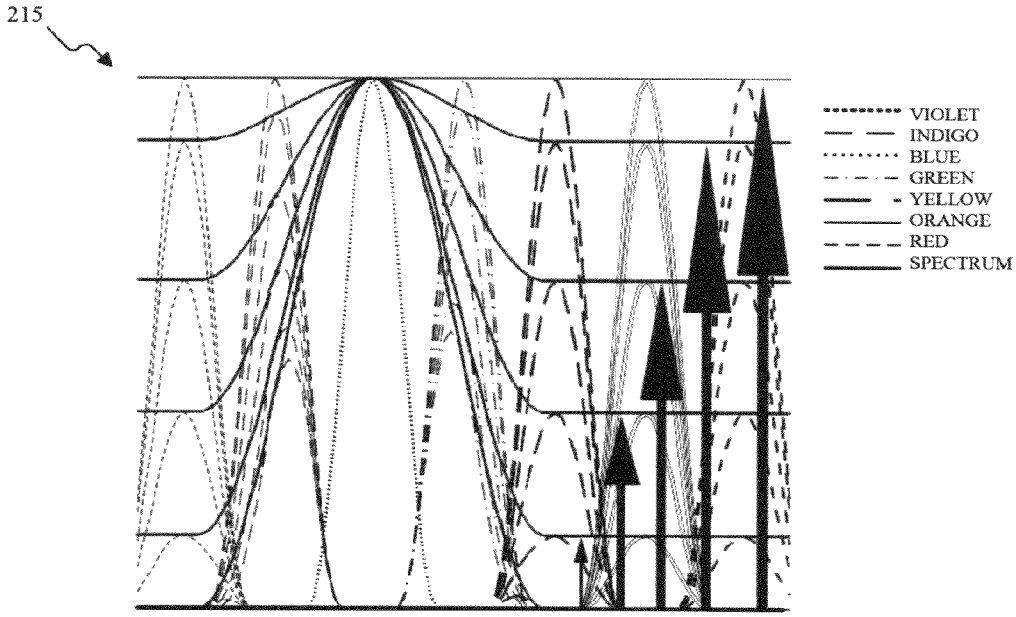
FIG. 8 illustrates the effect of saturation control.

Saturation ("S") is a value which proportionally modifies the intensities of all colors from the W and Q control output level to a white level in which all emitters are active and at a full output, as shown in diagram 215 of FIG. 8.

Figure 9:
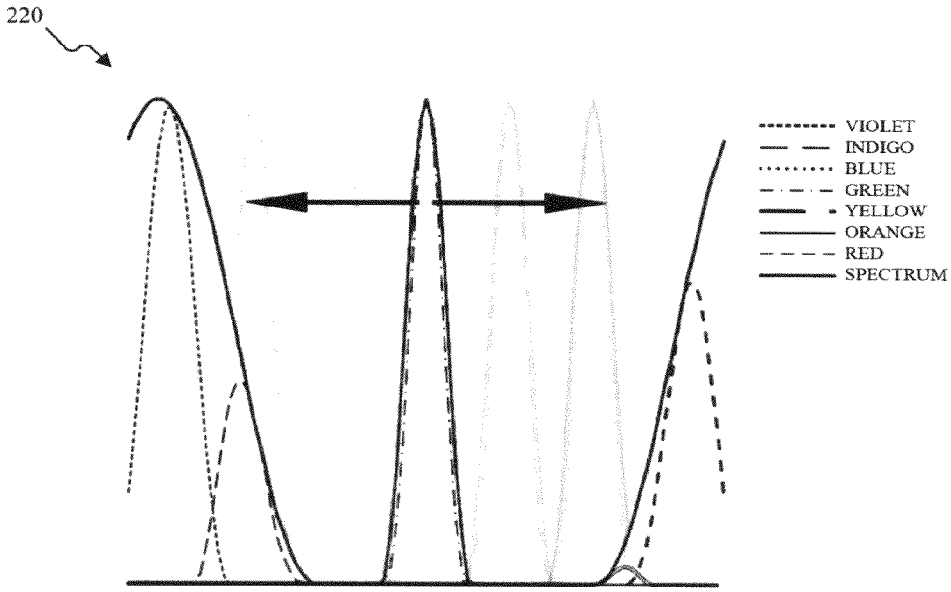
FIG. 9 illustrates the effect of tint control.

Tint ("T") is a value which adds a spectral color to the selected W and Q, as shown in diagram 220 of FIG. 9.

Figure 10:
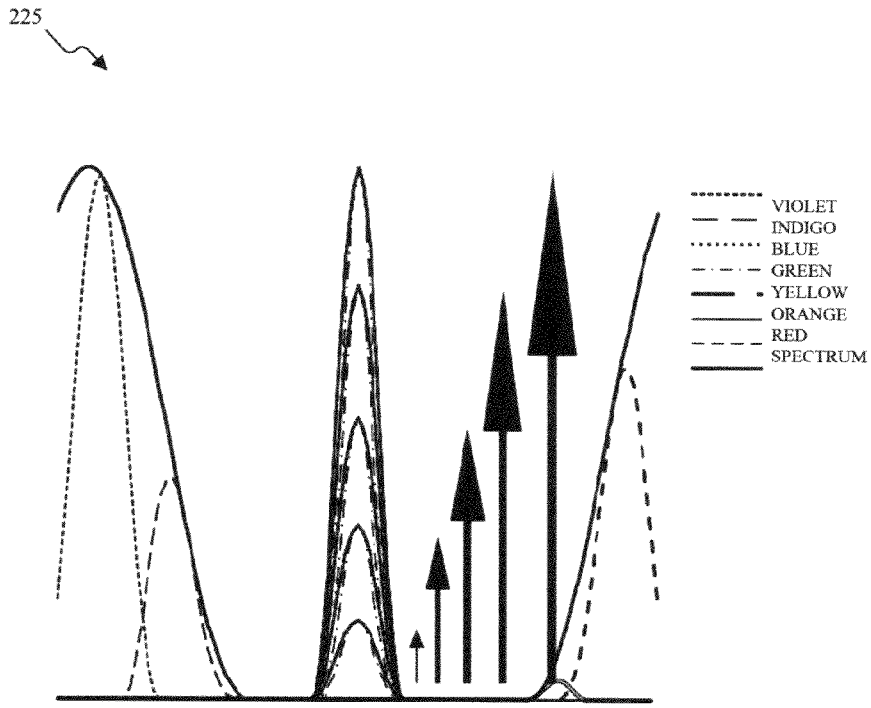
FIG. 10 illustrates the effect of colorize control.

Colorize or gain ("G") is a value which modifies the intensity of the spectral color added by T, as shown in diagram 225 of FIG. 10.

Intensity ("I") is a value which varies the intensity of the overall output of the luminaire.

Figure 11:
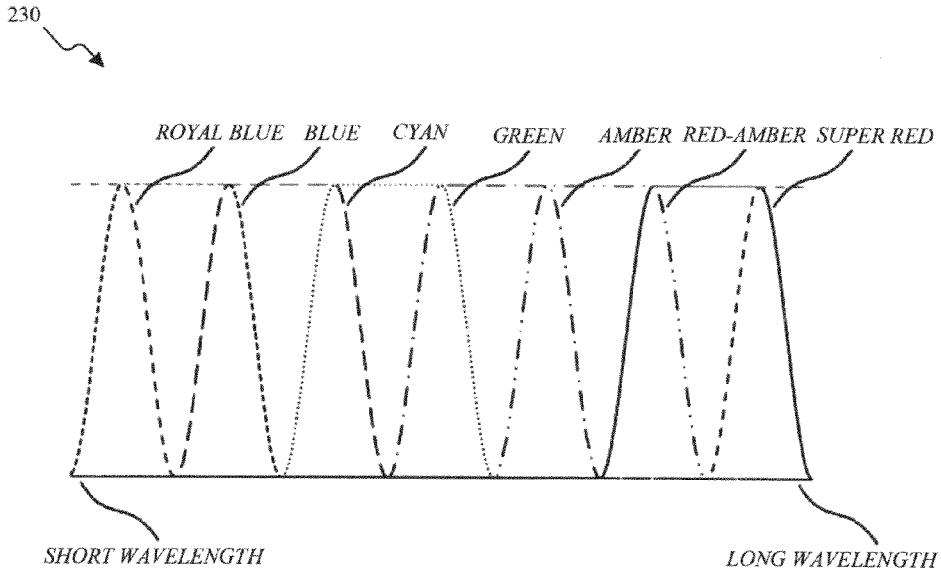
FIG. 11 illustrates relationships between output colors of light emitting diodes ("LEDs") with respect to wavelength.
Figure 12:
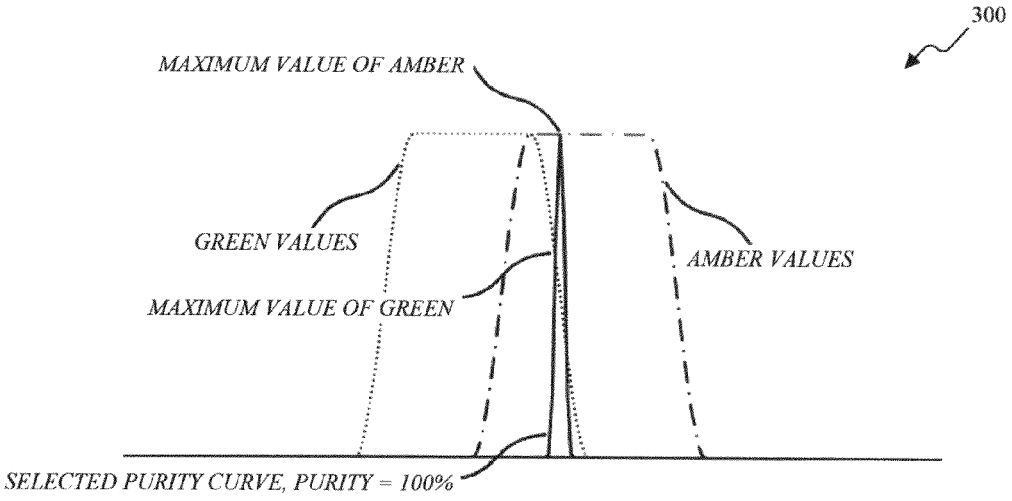
FIGS. 12-17 illustrate a first purity control technique according to an embodiment of the invention.
Figure 13:
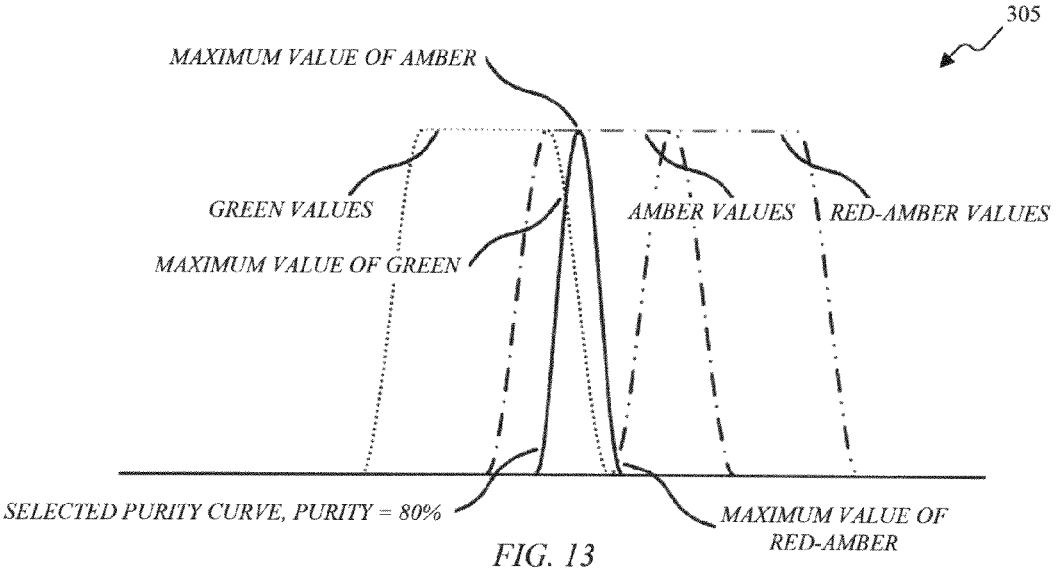
Figure 14:
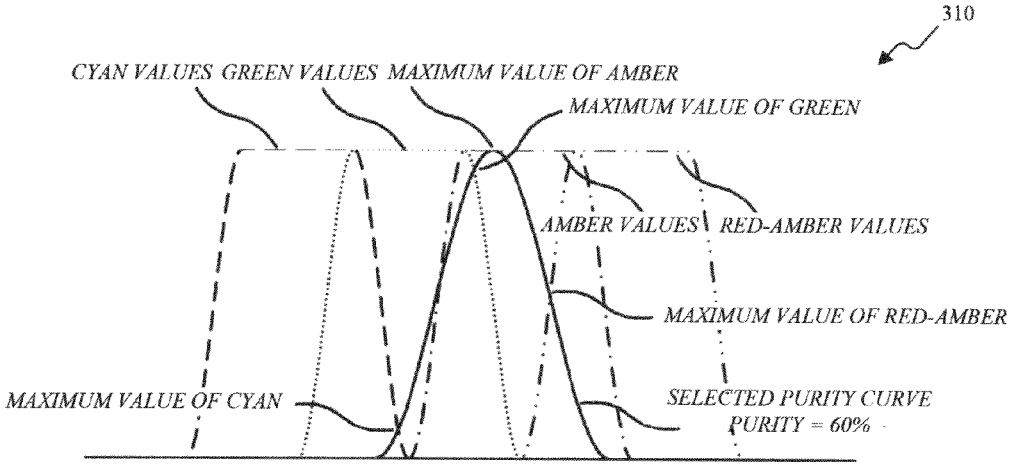
Figure 15:
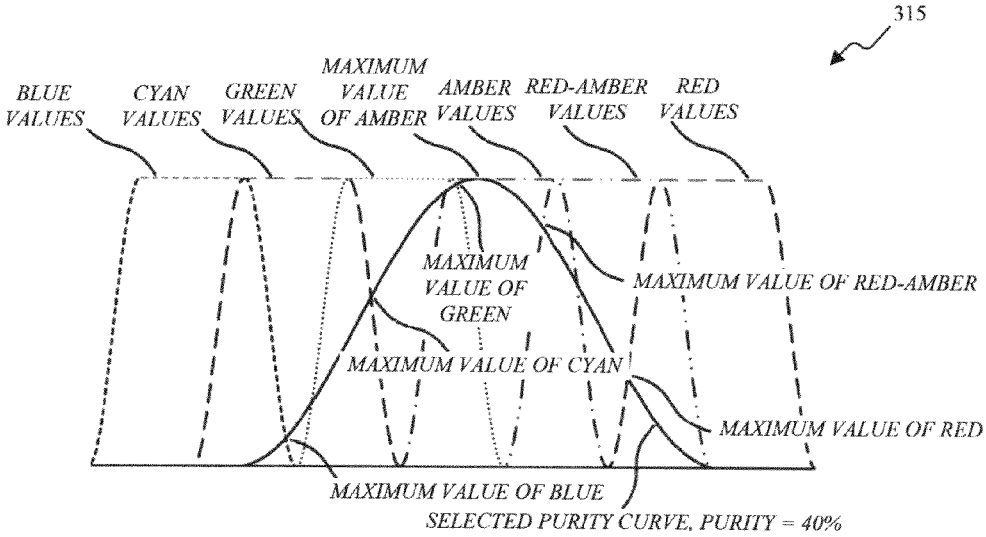
Figure 16:
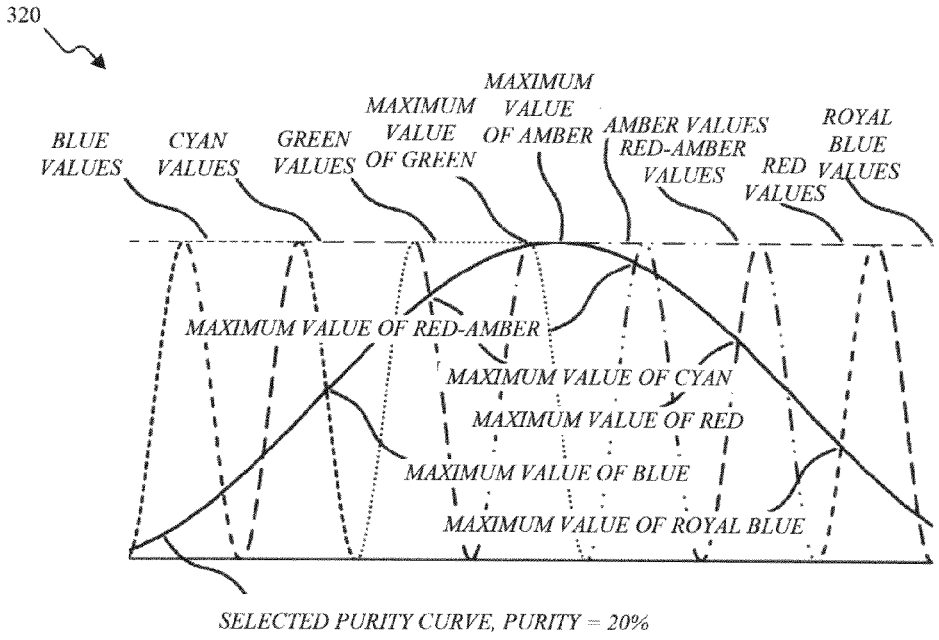
Figure 17:
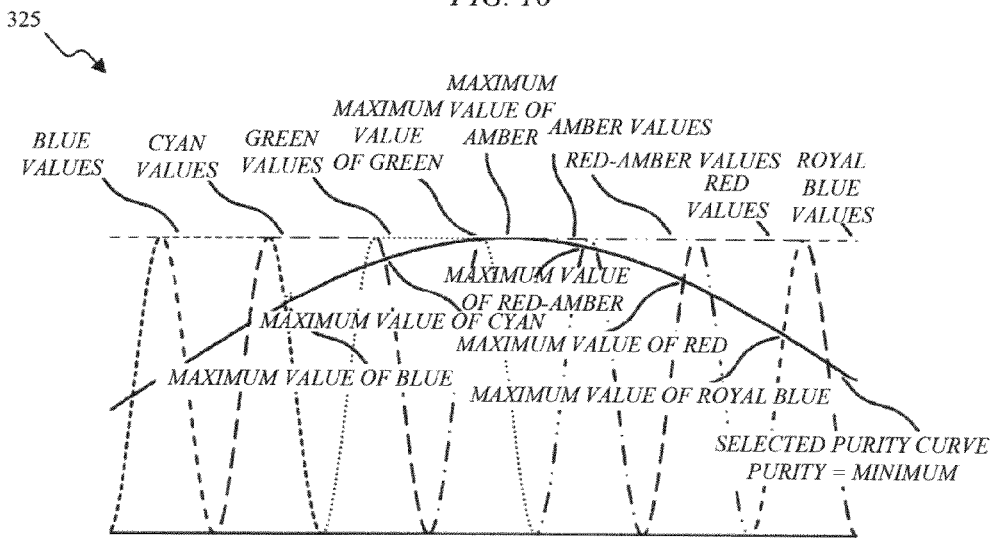
Figure 18:
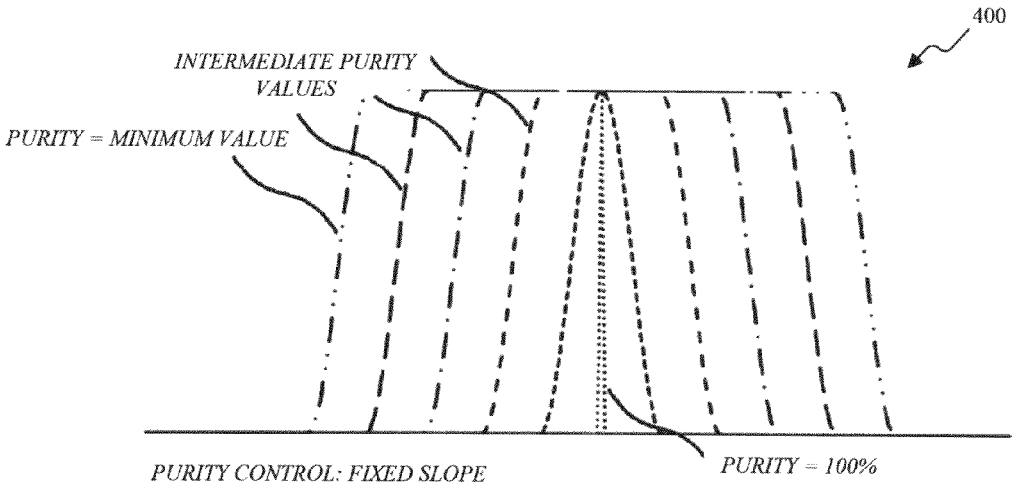
FIGS. 18-24 illustrate a second purity control technique according to an embodiment of the invention.
Figure 19:
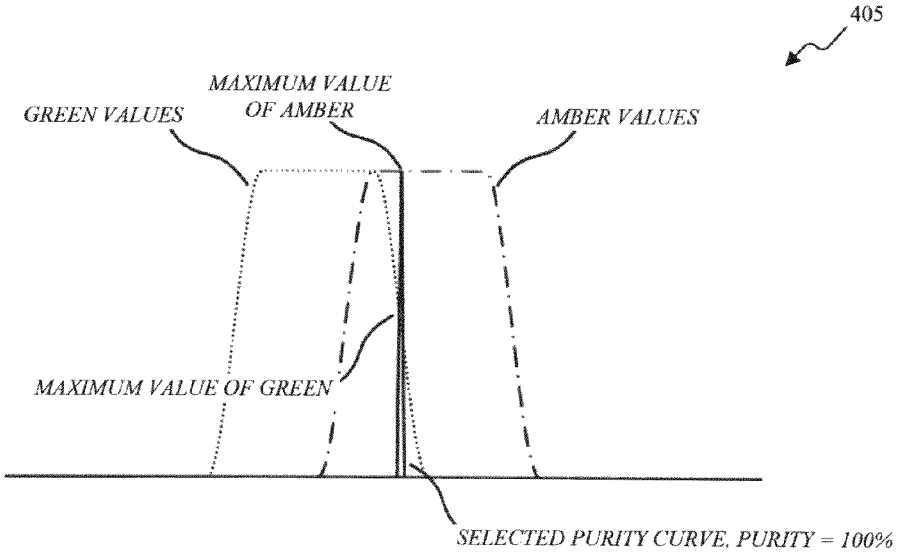
Figure 20:
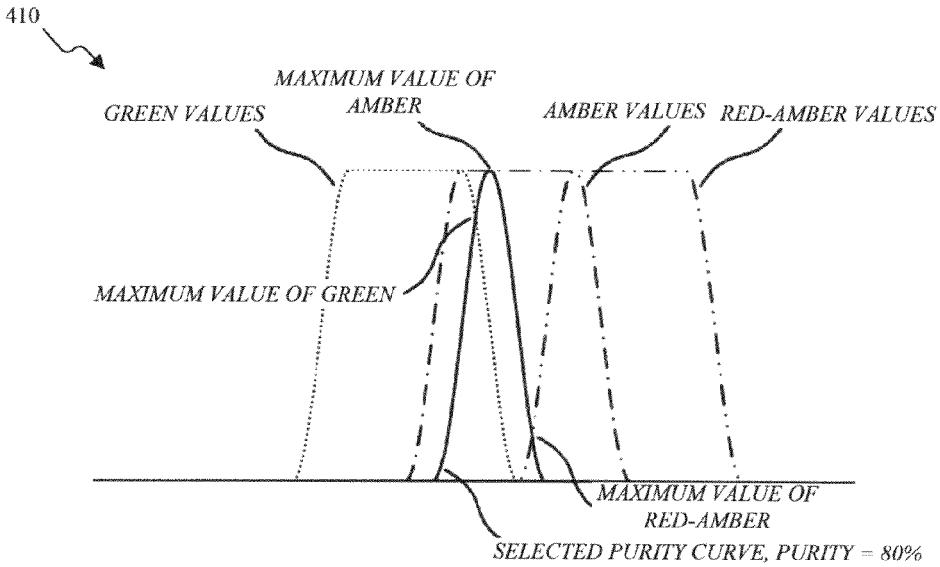
Figure 21:
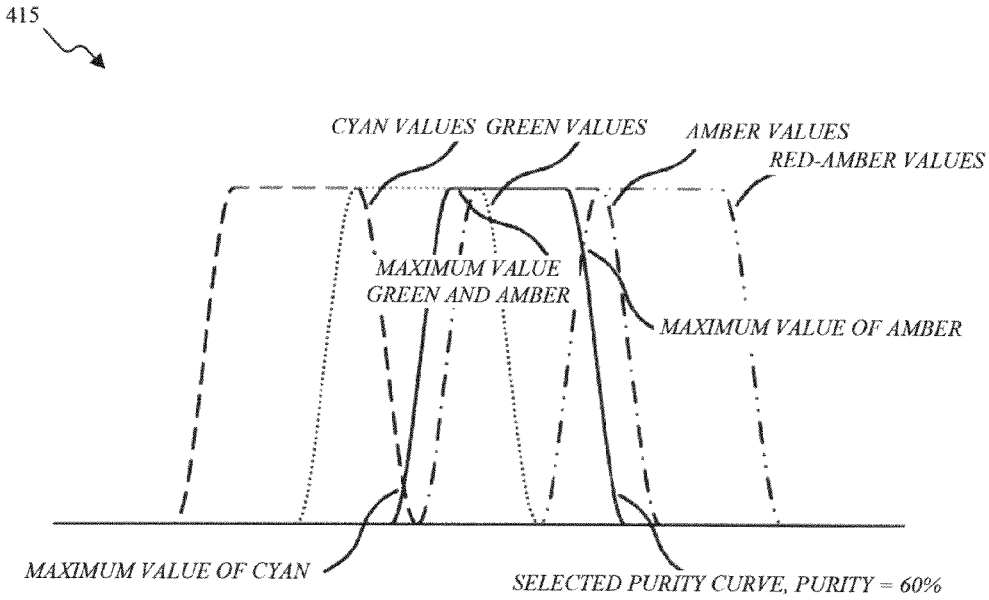
Figure 22:
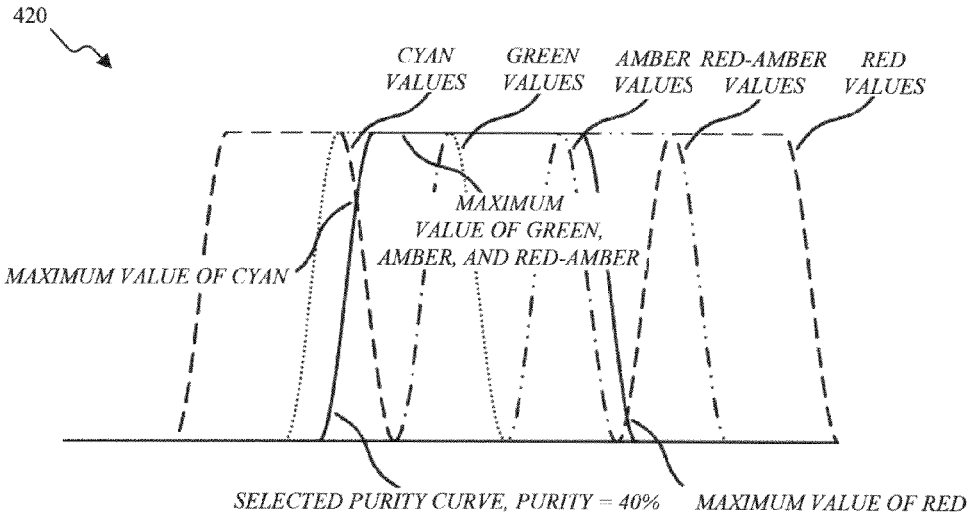
Figure 23:
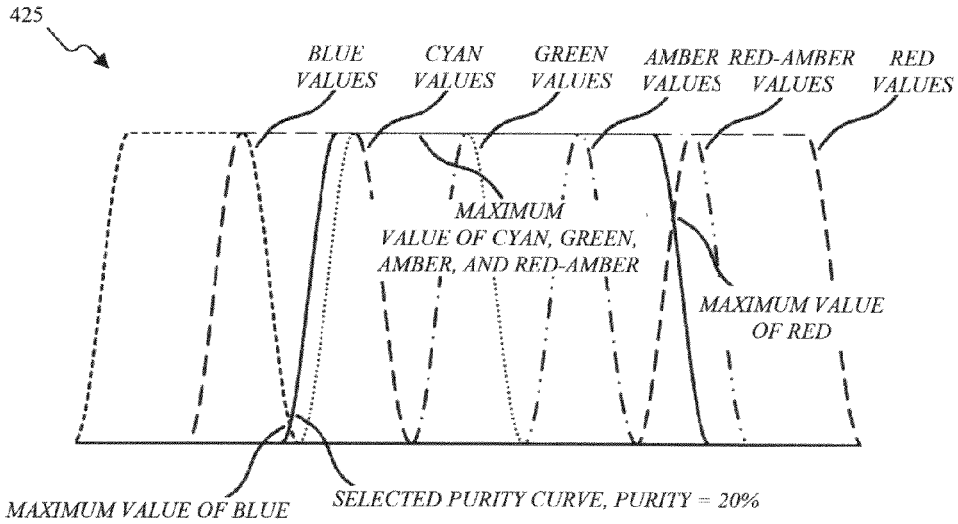
Figure 24:
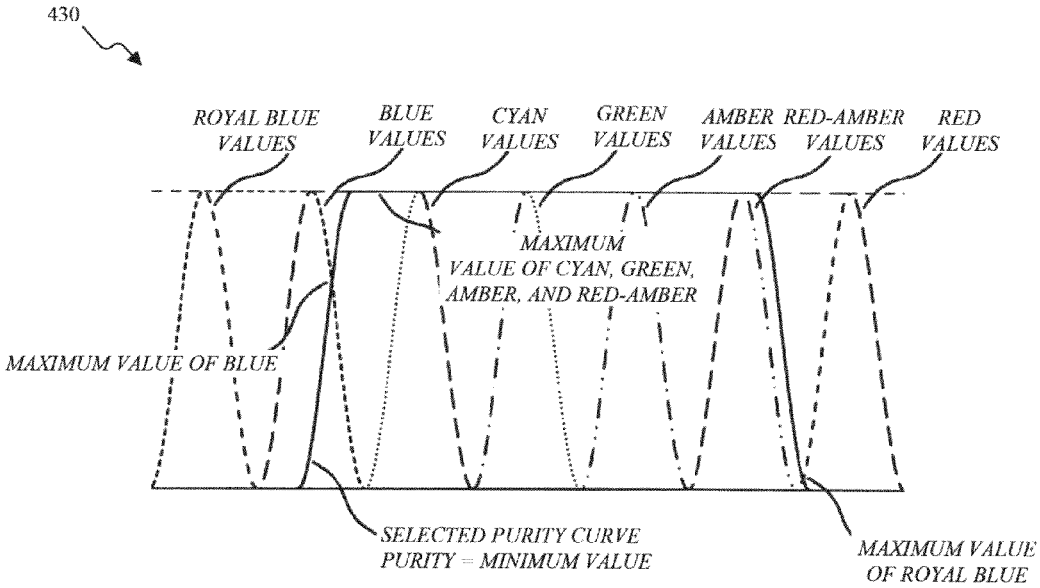
Figure 25:
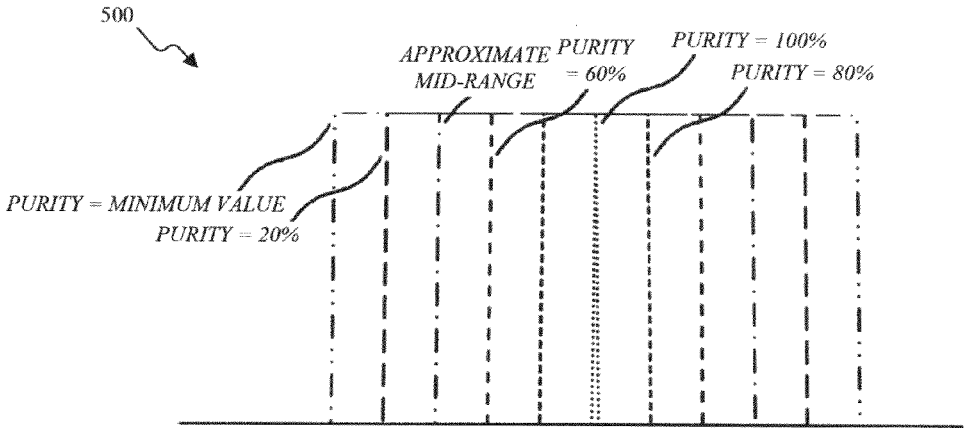
FIGS. 25-31 illustrate a third purity control technique according to an embodiment of the invention.
Figure 26:
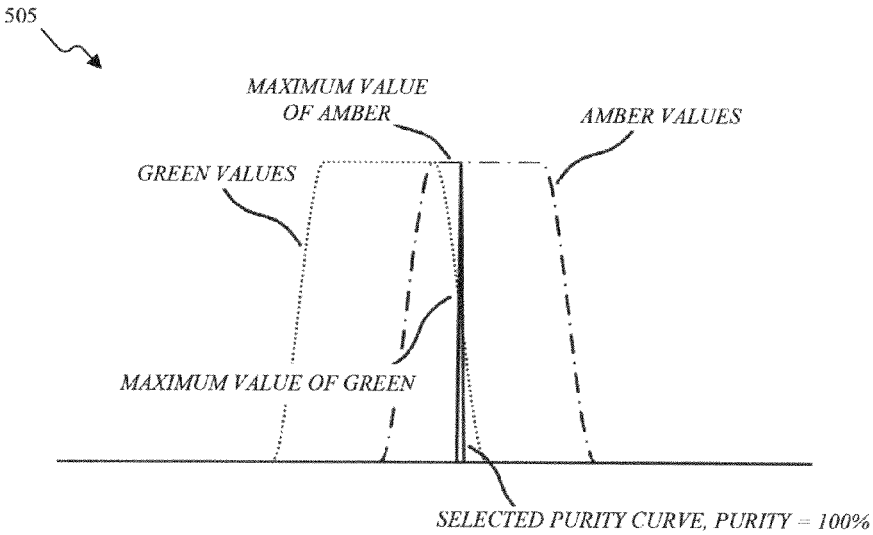
Figure 27:
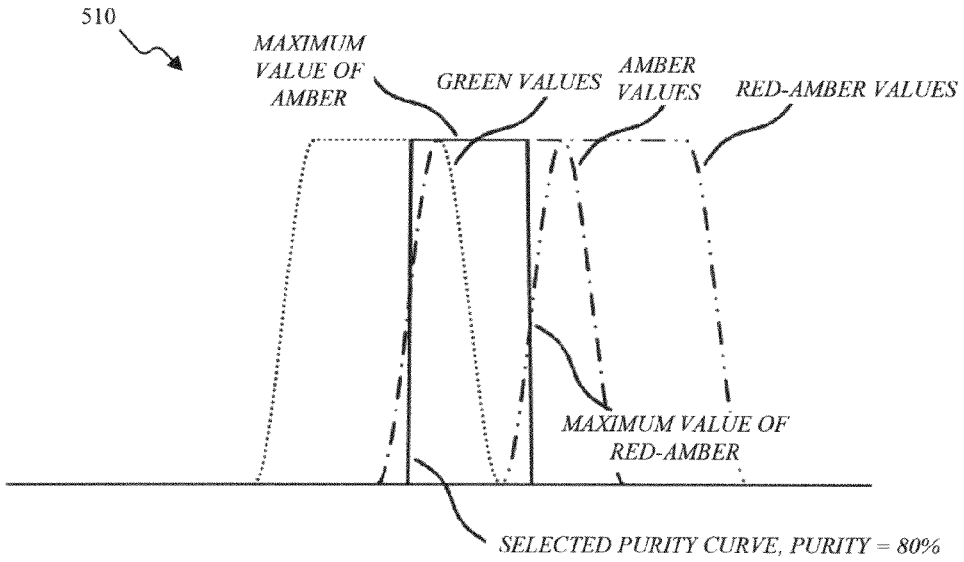
Figure 28:
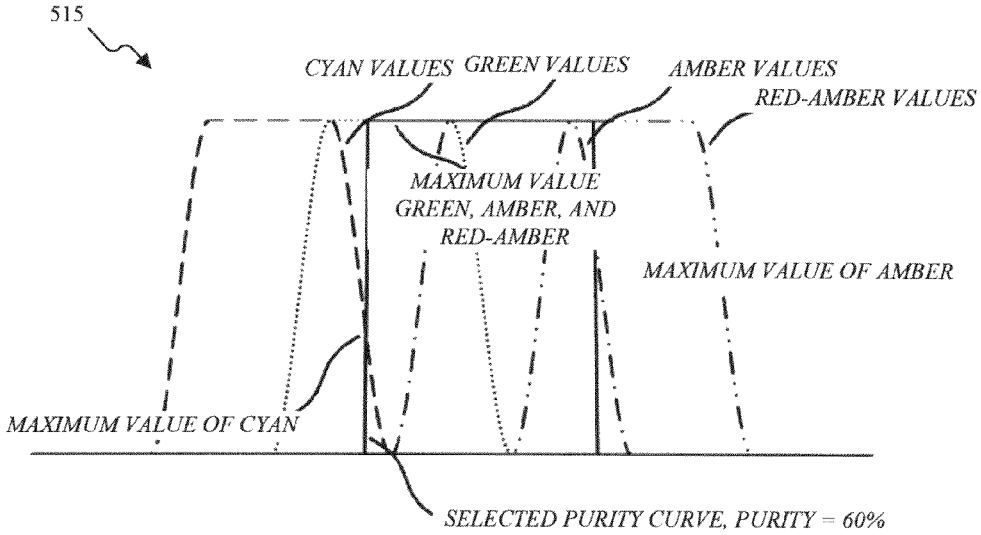
Figure 29:
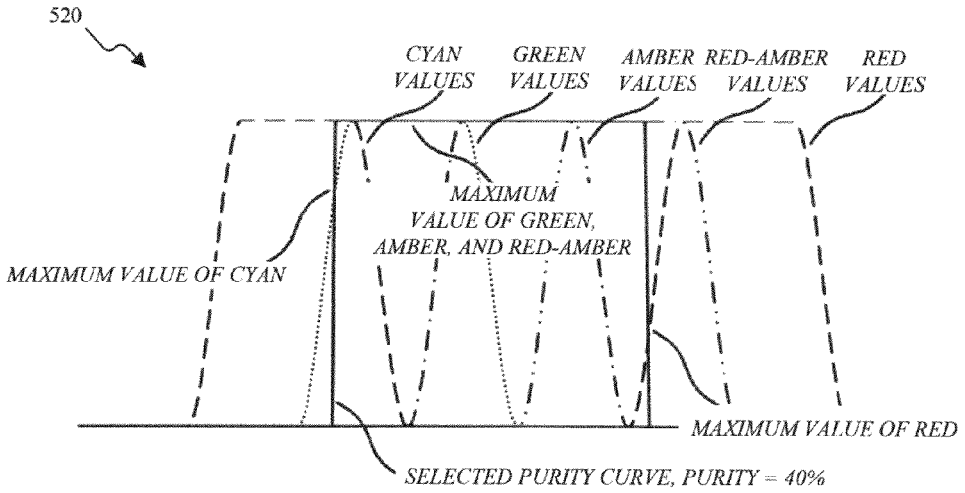
Figure 30:
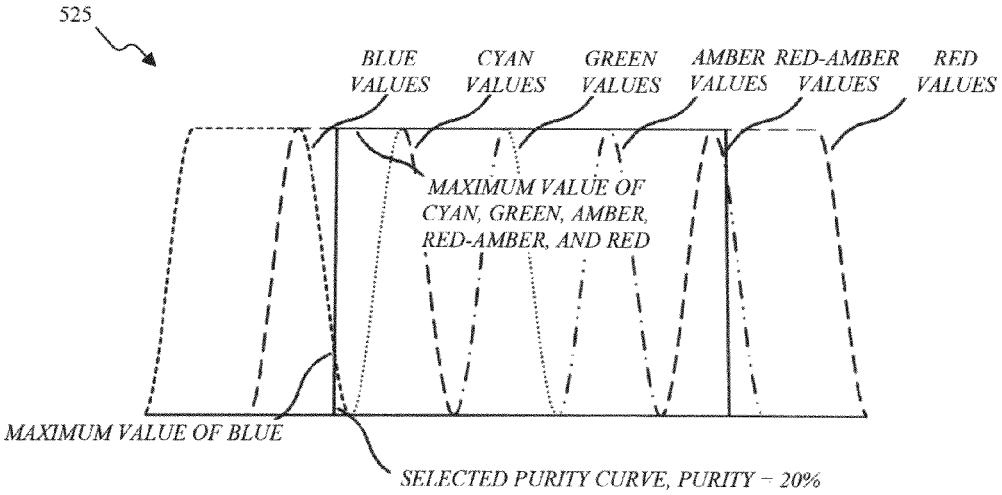
Figure 31:
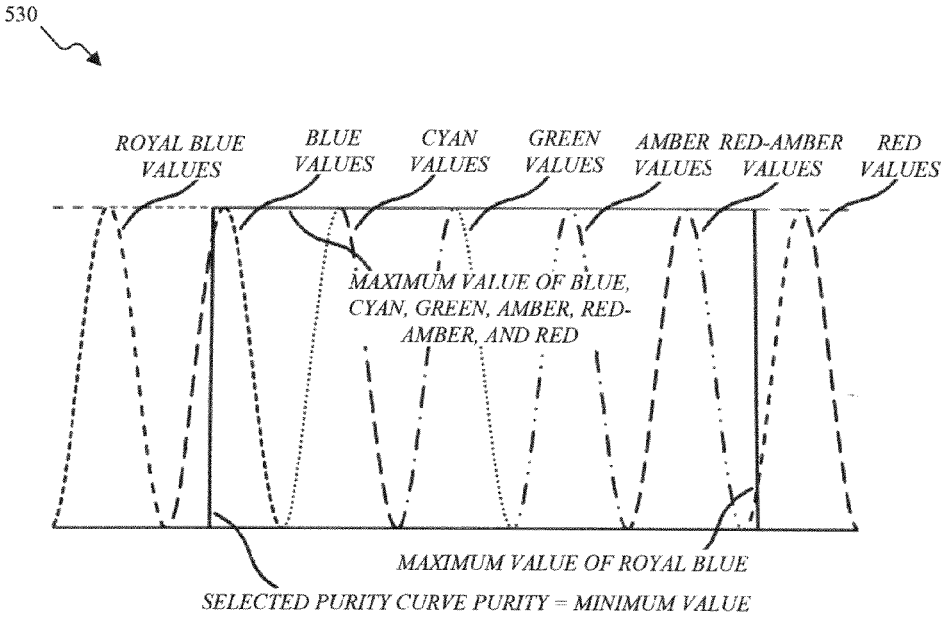

Hue control selects the value of the dominant wavelength, or base-color, as illustrated in FIG. 6. Hue control operates over the wavelengths of light in the visible spectrum from short-wavelengths such as violet at one extreme setting, to long-wavelengths such as red at the opposite extreme setting, and wraps around at each end of the spectral range (see diagram 230 of FIG. 11). The wrap-around area at each end of the visible spectrum enables the selection of colors in the magenta range of wavelengths which do not exist as pure spectral colors, and is similar to the manner in which the human brain perceives colors. Each color point which can be selected by the hue control is a fully saturated spectral color with a single dominant wavelength of light or a combination of adjacent spectral colors in varying proportions. In one embodiment, the hue control is implemented by indexing a hue value into tables of intensities required for each component color to combine to generate the desired hue. The intensities in the tables for the selected hue are then available for further manipulation by the other controls in the control set. In other embodiments, the hue control is included in a process defining a spectral response which is passed to another process that, in turn, converts the spectral response into the required drive levels for the available light sources. Other techniques for hue control which are known in the art can also be used.

Following the selection of a hue, purity control is used to alter the width of the spectrum centered at the selected hue's wavelength, as illustrated in FIG. 7. Purity control provides a user with the ability to control metamerism effects or color rendering. When the purity is set to 100%, the output of the luminaire is approximately a pure spectral color (e.g., green). As the purity is decreased, the wavelengths of light adjacent to green are gradually included. As the purity is decreased further, wavelengths of light further way from the central wavelength are added to the output of the luminaire. The effect of reducing the purity of the selected hue is to gradually widen the color gamut (i.e., bandwidth) until the output of the luminaire is, for example, pastel in color. The output of the luminaire then closely resembles a filtered black-body light source, and the output color is similarly rendered on colored backgrounds. As the purity of the selected hue approaches zero, the effect of a further reduction in purity are similar to the effect of increasing saturation. In some embodiments, saturation control is included in a modified form of purity control. In other embodiments of the invention, the purity of the selected hue is referred to as gamut width or metamerise.

Purity control is technically implemented by controlling the boundaries of values collected from tables of hue values. For example, purity control can be visualized as a curve which is applied to the hue values within the hue value tables. The curve is centered at the selected hue value, and the output values for the light sources are determined or calculated based on a proportion of the hue values for each color which fall within the curve. As the purity of the selected hue is modified, the width of the curve is modified. For example, when the purity control is set to a maximum value, a single point value corresponding to the selected hue is retrieved from the table or calculated. As the purity control value is reduced, hue values on either side of the selected hue are retrieved or calculated in proportion to a distance from the selected hue. This proportion is scaled or determined using any of a variety of techniques. Three such techniques are described below, although other techniques, or variations of the described techniques, can also be used.

When the purity control value for the selected hue is decreased the wavelengths of light adjacent to the selected hue are added progressively (e.g., continuously), sequentially (e.g., in discrete intervals), or a combination of progressively and sequentially. Additionally or alternatively, the range of wavelengths or wavelength values selected using the hue and purity controls are included in a process which defines a spectral response. The spectral response is then converted to the required drive levels for each of the available light sources.

In one embodiment, the width of a purity curve is modified by varying the slope of the curve. Diagrams 300-325, shown in FIGS. 12-17, illustrate the modification of the slope of the purity curve centered at a yellow-green hue as a purity control value is modified from 100% to a minimum value (e.g., 0.0%). Such a technique has the effect of including colors nearer or further away from the centre point proportionally and gradually as the purity control value is decreased. In the illustrated embodiment, the maximum value for each hue within the purity curve is shown. The resulting output value for each hue is proportional to the area enclosed by the purity curve and the values within the hue tables. A single value is selected from each hue table (e.g., each light source has its own table) to determine the output of each light source in the luminaire.

In another embodiment, the purity curve increases until the slope of the curve is equal to the slope of the light source emission curves, which correspond to values within the hue tables. As the purity control value is decreased, the curve is progressively widened while maintaining the same slope as the emission curves. Diagrams 400-430, shown in FIGS. 18-24, illustrate a purity curve centered at a yellow-green hue. The purity of the selected hue is modified from 100% to a minimum value (e.g., 0.0%). In a manner similar to that described above, the maximum value for each hue within the purity curve is identified, and the resulting output value for each light source is selected from the hue tables. A single value is selected from each hue table to determine the output of each light source in the luminaire. In the illustrated embodiment, hues which are completely enclosed by the purity curve correspond to a maximum value in their respective tables.

In another embodiment, the purity curve has an undefined slope as additional wavelengths are included in the output of the luminaire, as illustrated in diagrams 500-530 of FIGS. 25-31. Such an embodiment is also referred to as a square or box technique. As the purity control value is modified, the width of the box is increased. As such, modifying the purity control value includes adjacent wavelengths of light in an output of the luminaire at a full-scale value before wavelengths of light further away from the selected hue are included. In the illustrated embodiment, which is centered at a yellow-green hue, a maximum value for amber is included in the output before any green is included in the output.

Following selection of a hue and the modification of the hue's purity, saturation control is used to proportionally control the values of each output color between the selected hue and purity values and their full-scale values (see FIG. 8). Controlling saturation in this manner is similar to controlling saturation using the hue, saturation, intensity ("HSI") control technique for a three light source controller. The saturation control is operable to increase the level of white in an output color proportionally until, at a maximum setting, there is no dominant hue and all output colors are equally present (e.g., the output appears white). The colors are equally present in that they are perceived as having equal brightness because of the spectral response of the human eye, even though the radiant powers of the various output colors are not equal In one embodiment, the saturation control is technically implemented using a calculation for each point within the spectrum, as shown below.

EXAMPLE SATURATION CALCULATION for $\lambda$=430-650 nm:

$$\text{int_val}=(\text{int_val}+((1-\text{int_val})*\text{sat_val}))*(\text{curve_val at } \lambda)$$

where $\lambda$ is the wavelength of light, int_val is an intensity or brightness at the selected wavelength, sat_val is a saturation value scaled from 0 to 1, and curve_val is the value of the purity curve for a light source at the selected wavelength. The above formula is executed for each light source. In some embodiments, and as described above with respect to the hue and purity controls, the saturation controls can also be included in a process which defines a spectral response. The spectral response is then converted to the required drive levels for each of the available light sources. Additionally, although saturation control is described as occurring following hue and purity controls, saturation control can also be performed before adjusting hue, purity, or any other controls included in the control set.

In some embodiments, additional spectral colors (e.g., additional hues) are added to the primary selected hue. Although any number of additional hues can be added to the selected hue, most practical implementations of the control set only require the addition of one hue. The described control techniques can be modified to add more than one hue to the selected hue. In one particular embodiment, two sets of controls are provided. The first set of controls is used to generate a dominant hue, such as deep blue. The first control set includes the hue, purity, and saturation controls described above. The second control set is used to add (or alternatively subtract) a second sub-dominant hue from the dominant hue, such as a low-intensity partially saturated red. The result of such an addition is an output color which resembles the color congo blue, which is a color that produces a warm glow on human skin due to the additional of the red hue. The red is nearly indistinguishable when viewing white objects, but due to the high reflectance of red from human skin, the red provides a perception of warmth. In another embodiment, the second control set is used to modify a color to compensate for metamerism (i.e. to correct an output color based on the color of the background it is illuminating). In such an embodiment, the second control set allows a color which is for the most part satisfactory, to be perceived as warmer or cooler.

The second control set includes, for example, a tint control and a colorize control. The tint control operates in much the same manner as the above-described hue control. However, to distinguish the two controls, 'tint' is used to describe the secondary additive or subtractive hue. With reference once again to FIG. 9, the tint control adds a single spectral color to the colors selected using the hue and purity controls. A tint control value is selected from, for example, a table of tint values.

The colorize control modifies the intensity of the secondary hue selected by the tint control (see FIG. 10). As the colorize control value is increased, the tint control values selected from the table of tint values are increased. Additionally or alternatively, the range of wavelengths and wavelength values selected using the tint and colorize controls are included in a process which defines a spectral response. The spectral response is then converted to the required drive levels for each of the available light sources.

In some embodiments, the control set also includes an overall intensity control. The overall intensity control is analogous to a master volume or output level on an audio equalizer, and is a separate control which modifies the overall intensity of the color output (e.g., the output of the luminaire). The overall intensity control is either included in the control set, or directly controls the output of the luminaire. For the purposes of this description, the overall intensity control is assumed to be at a maximum value for all examples, and is not described further.

Figure 32A:
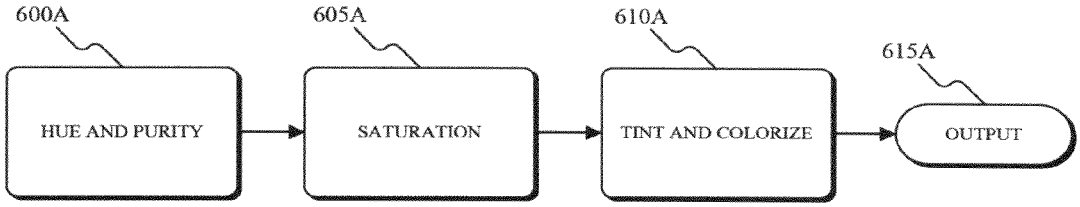
FIGS. 32A-32D illustrate luminaire output control processes for various embodiments of the invention.
Figure 32B:
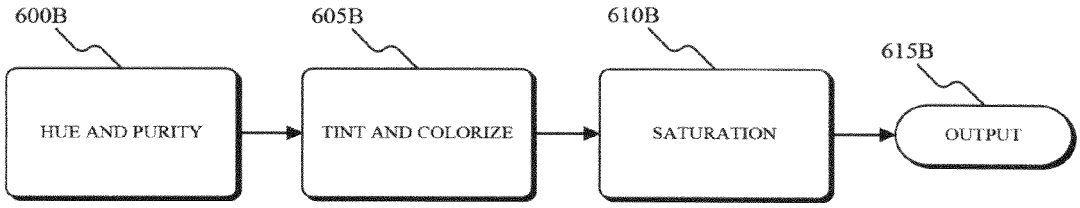
Figure 32C:
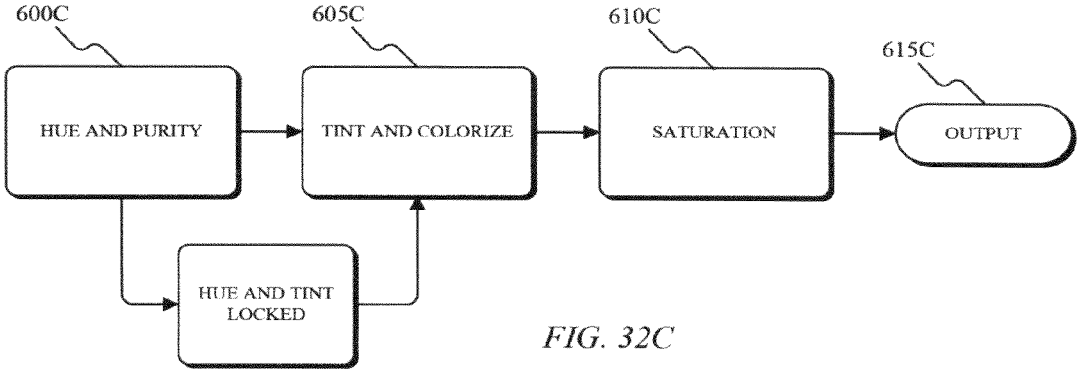
Figure 32D:
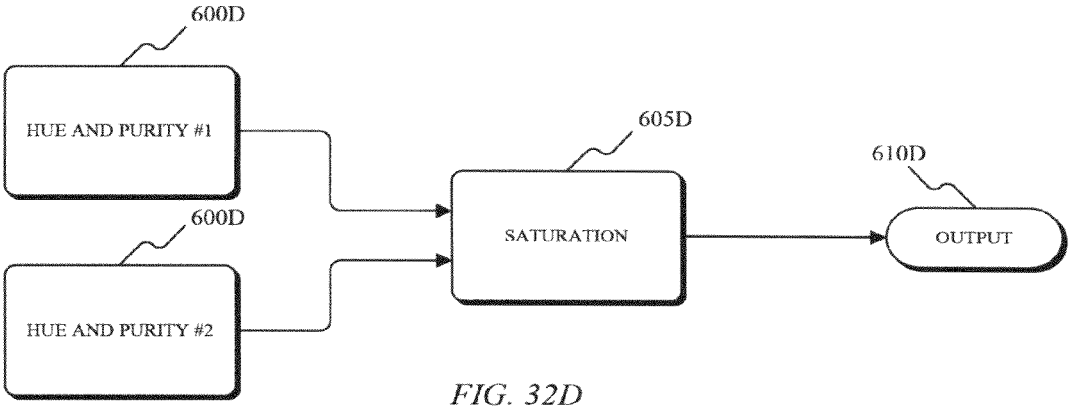
Figure 33:
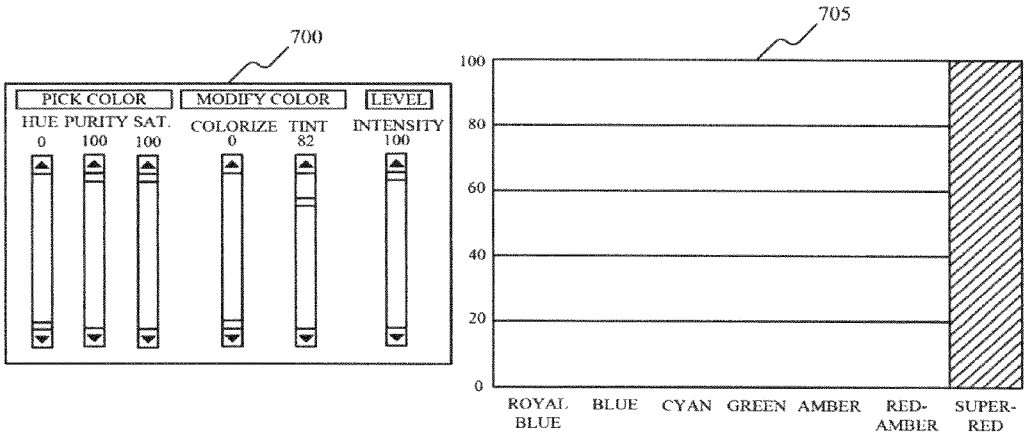
FIGS. 33-42 illustrate a control set and the effect of hue control on the outputs of the light sources within a multiple light source luminaire.
Figure 34:
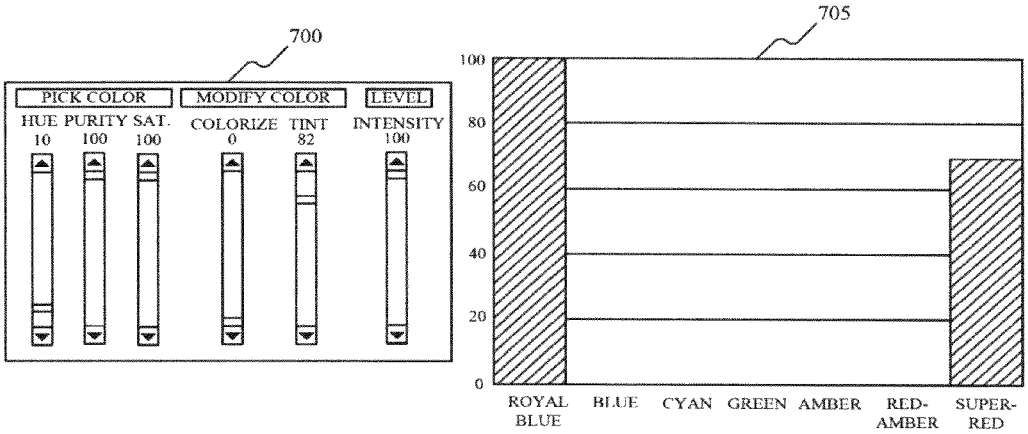
Figure 35:
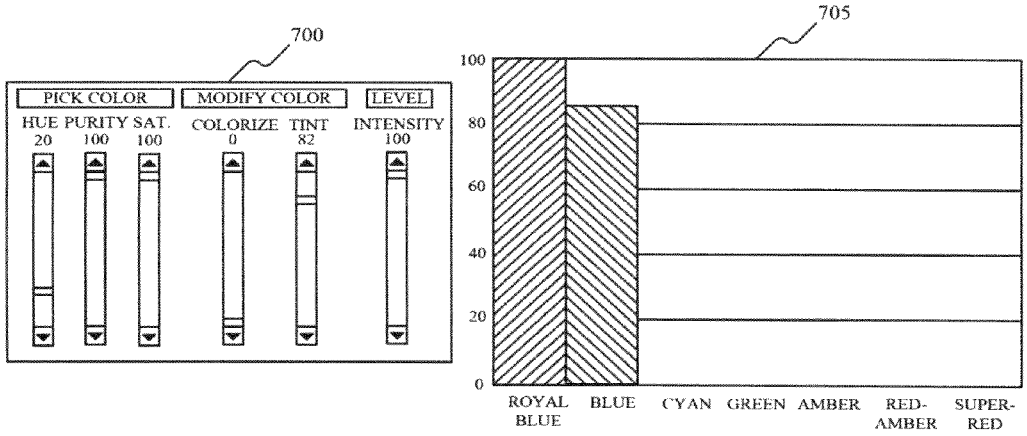
Figure 36:
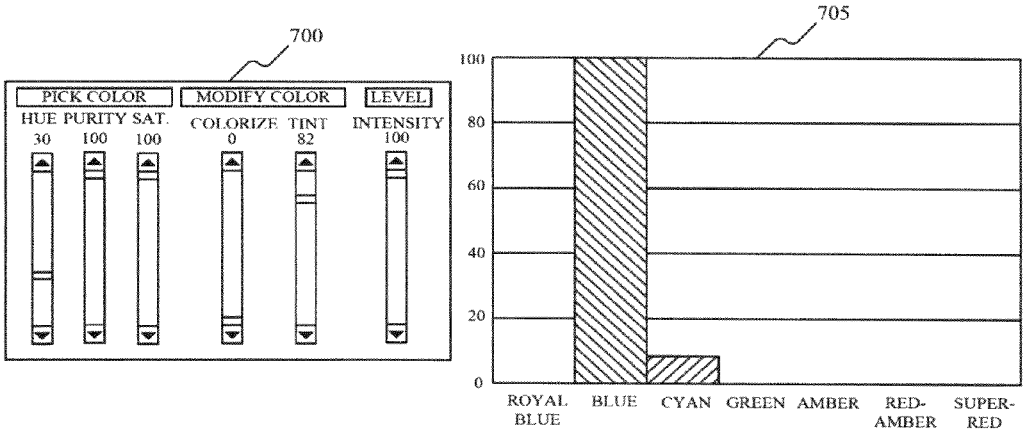
Figure 37:
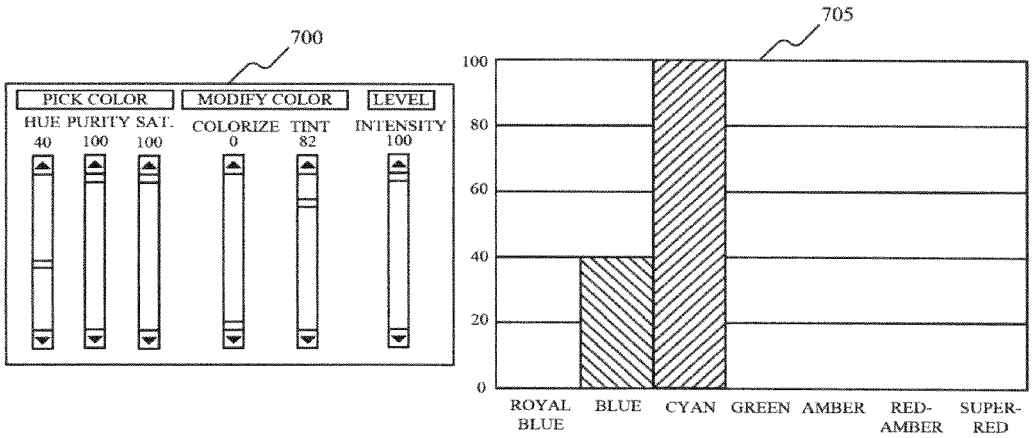
Figure 38:
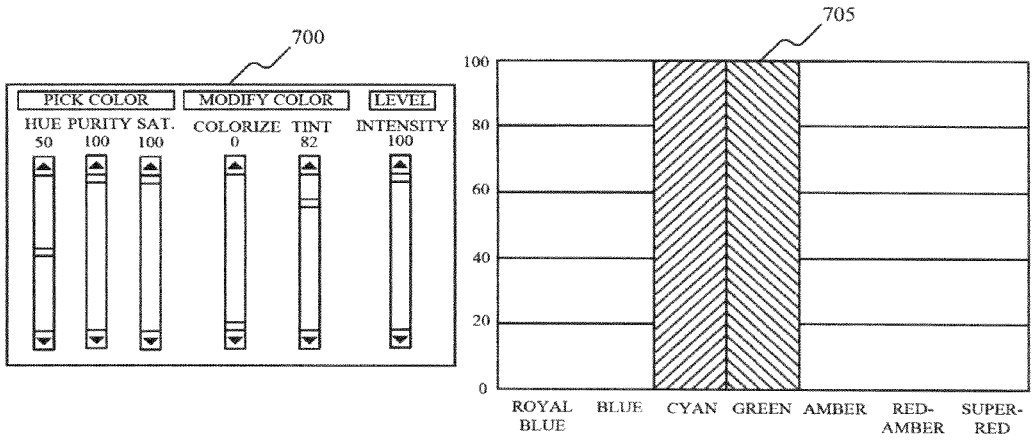
Figure 39:
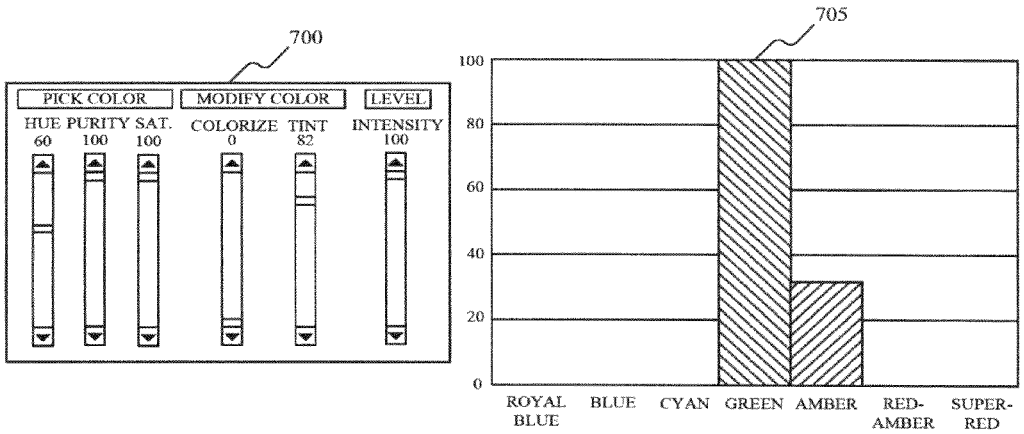
Figure 40:
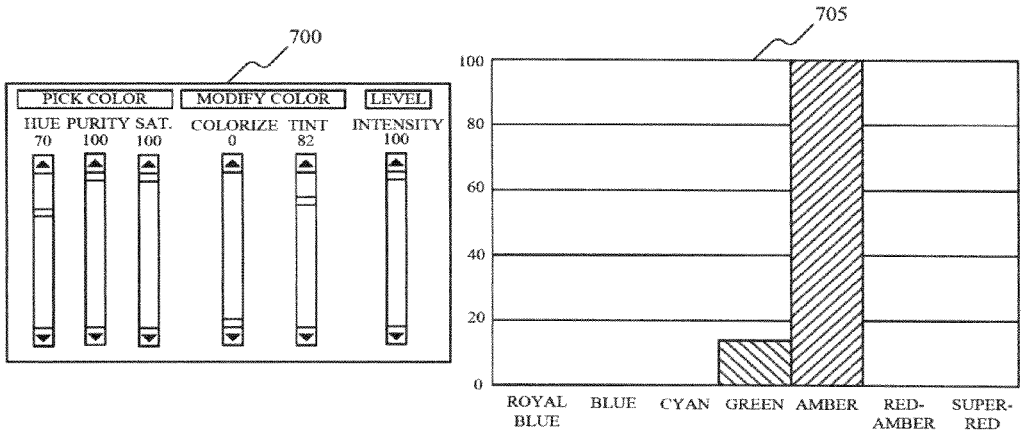
Figure 41:
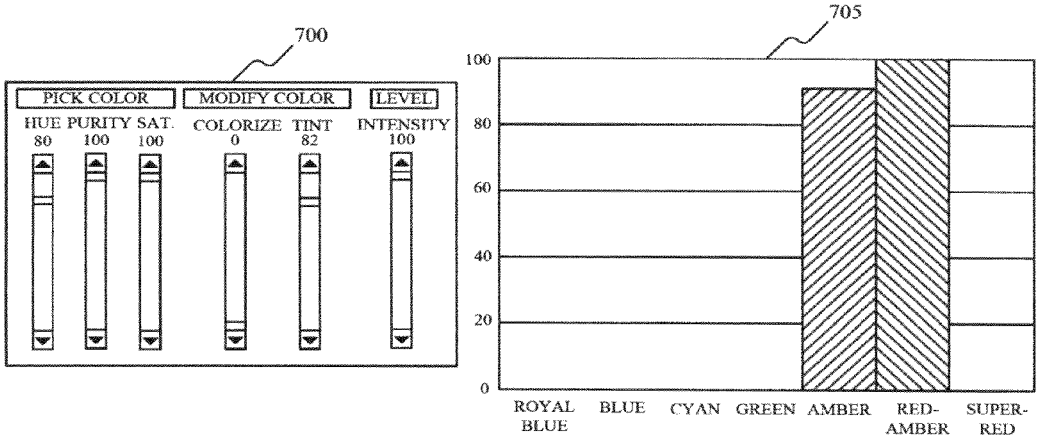
Figure 42:
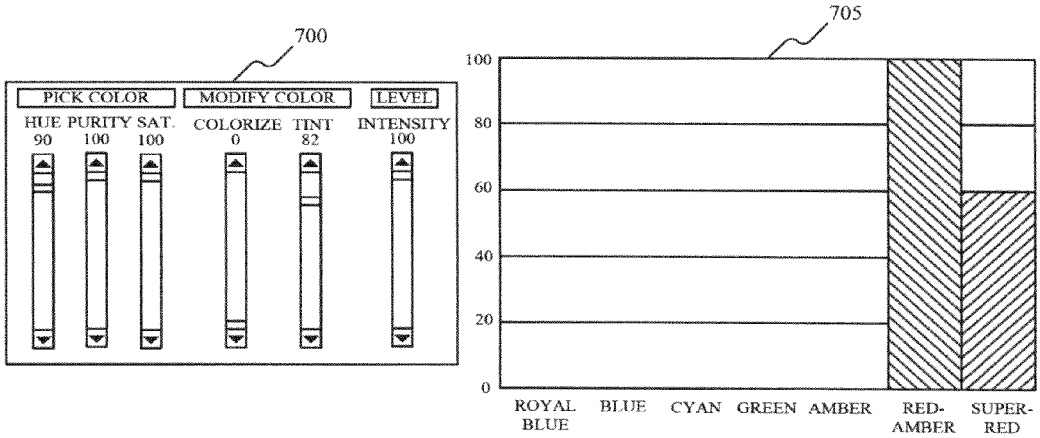
Figure 43:
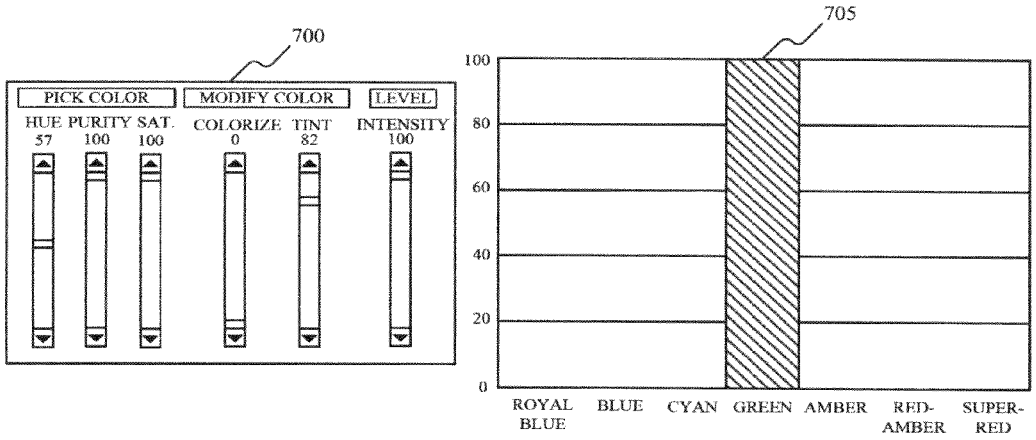
FIGS. 43-50 illustrate a control set and the effect of purity control on the outputs of the light sources within a multiple light source luminaire.
Figure 44:
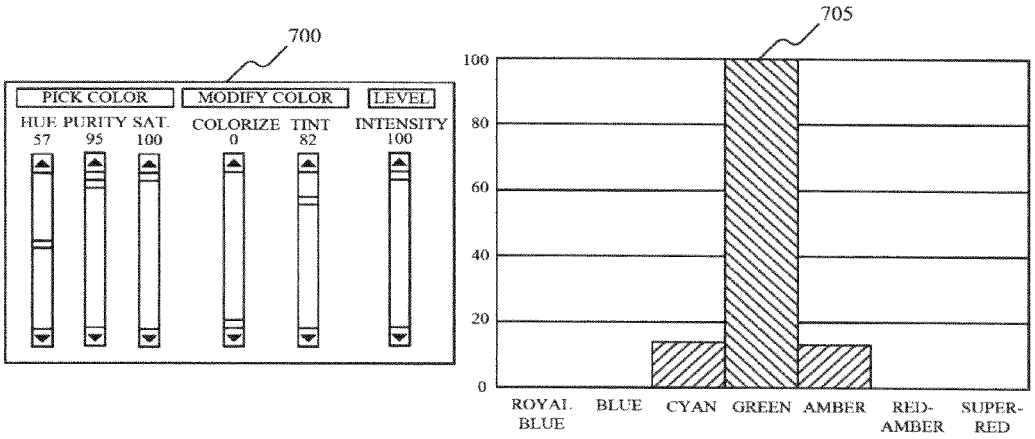
Figure 45:
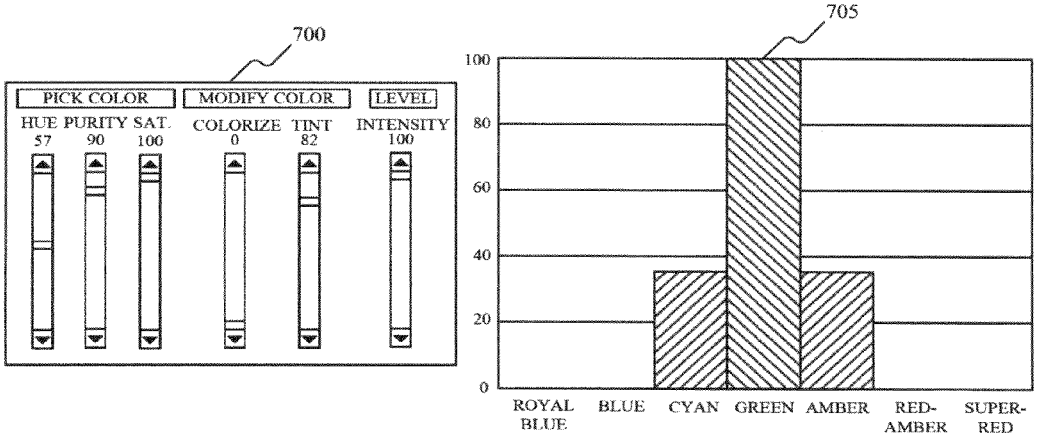
Figure 46:
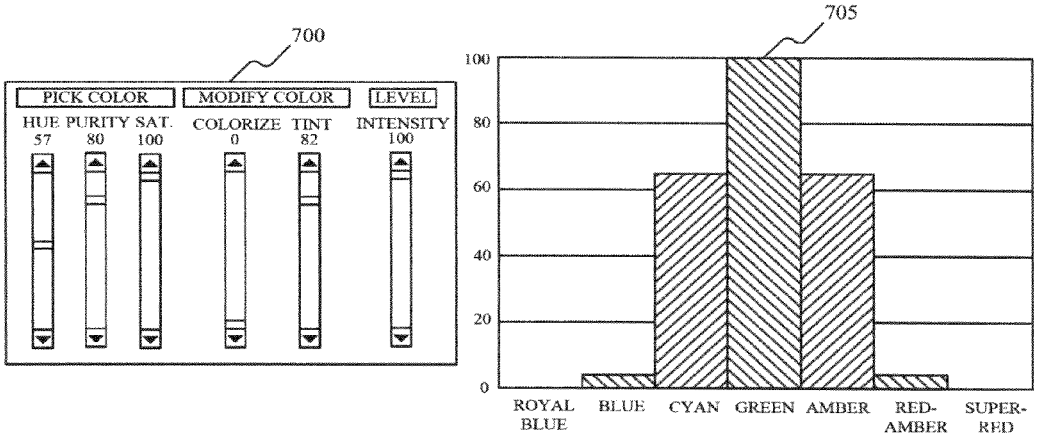
Figure 47:
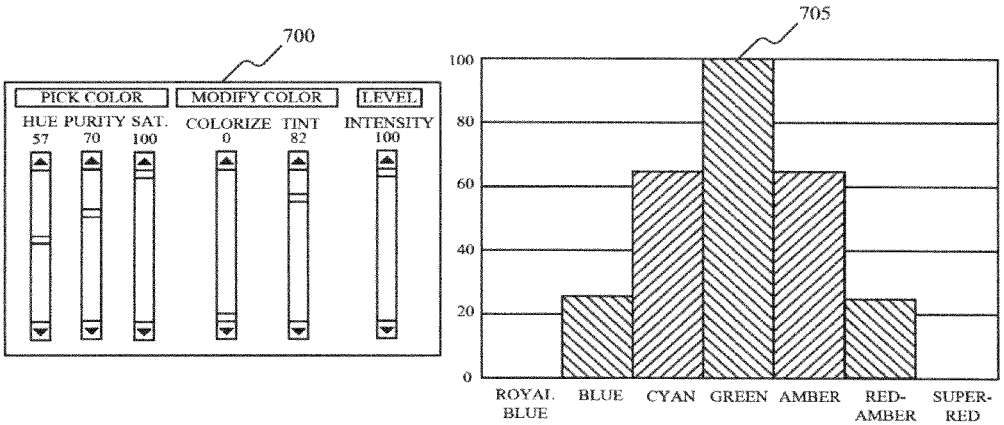
Figure 48:
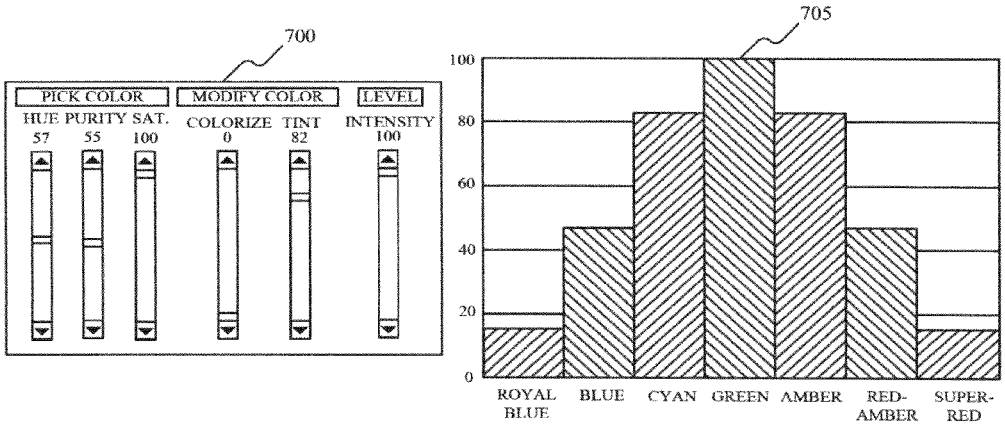
Figure 49:
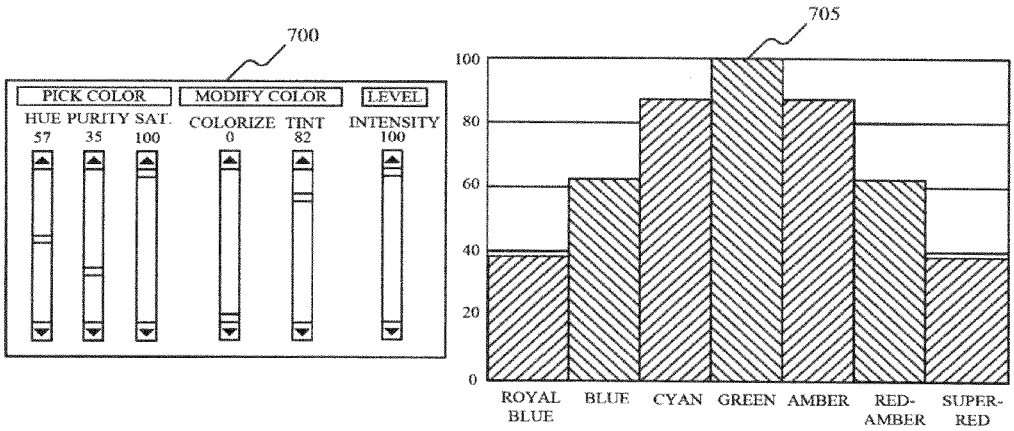
Figure 50:
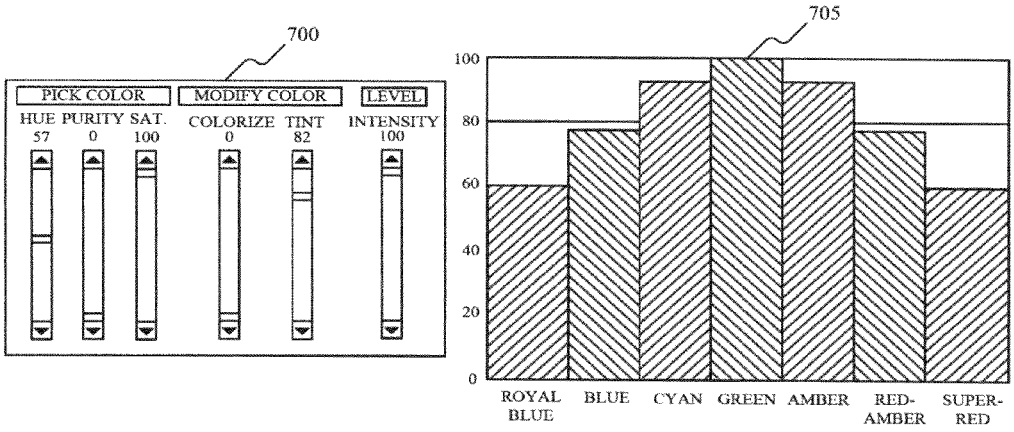
Figure 51:
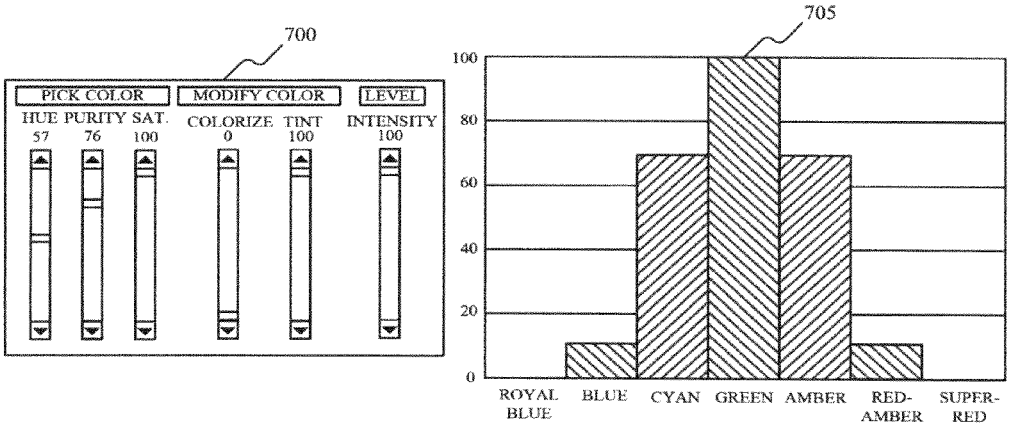
FIGS. 51-56 illustrate a control set and the effect of colorize control on the outputs of the light sources within a multiple light source luminaire.
Figure 52:
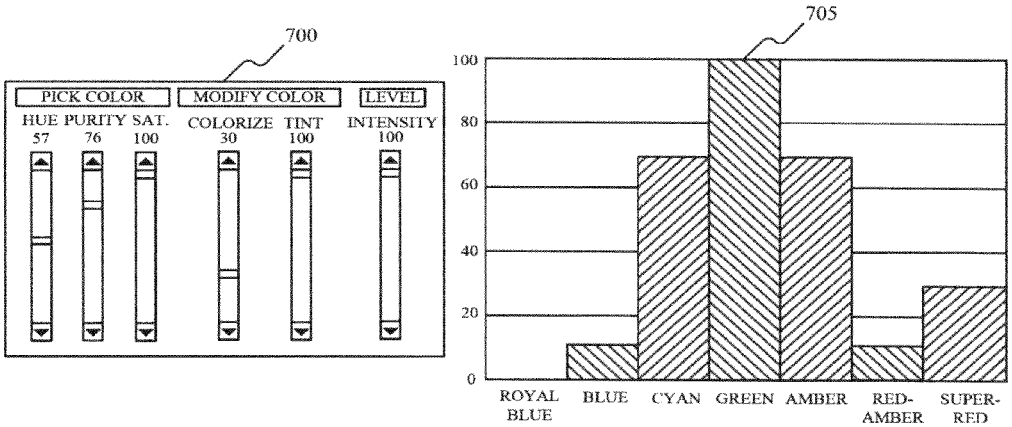
Figure 53:
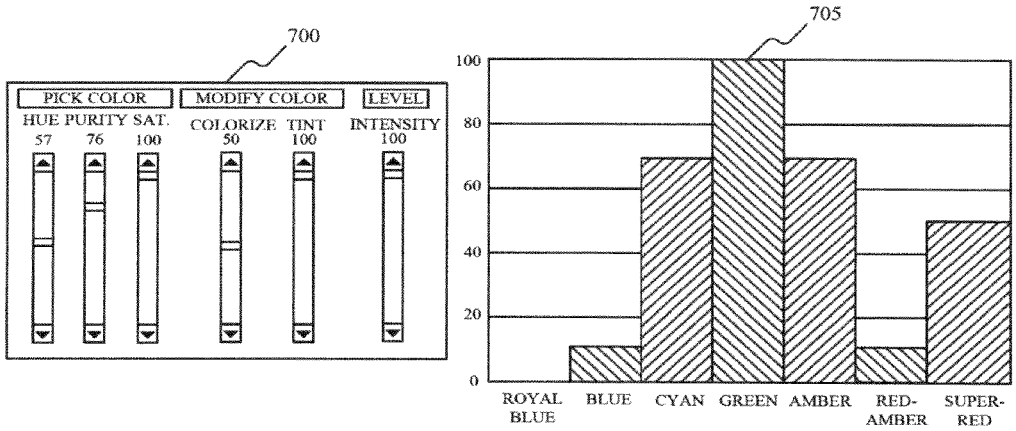
Figure 54:
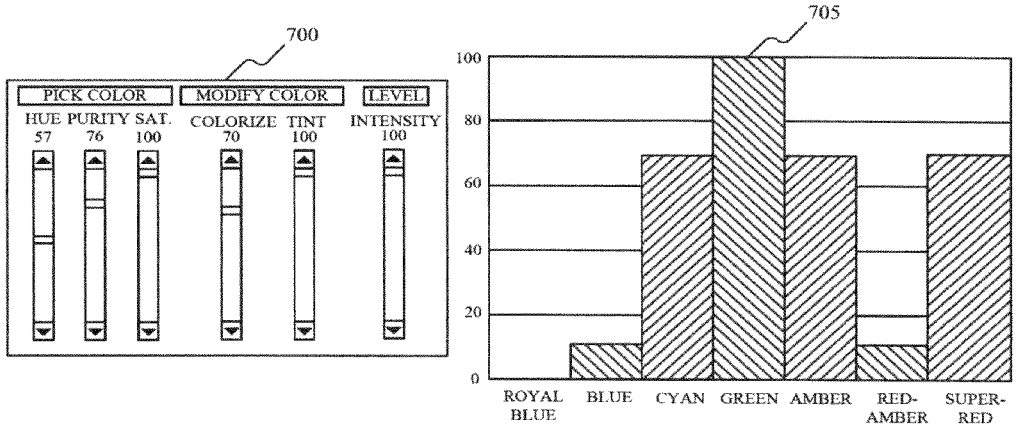
Figure 55:
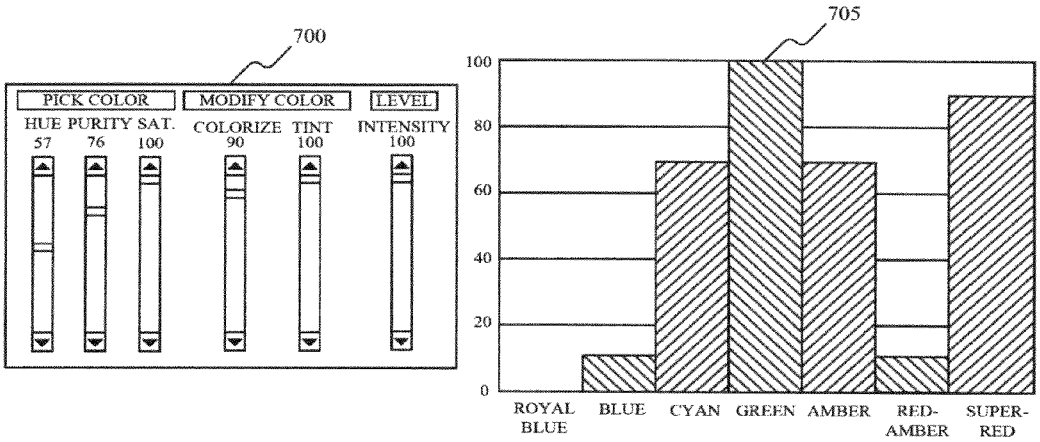
Figure 56:
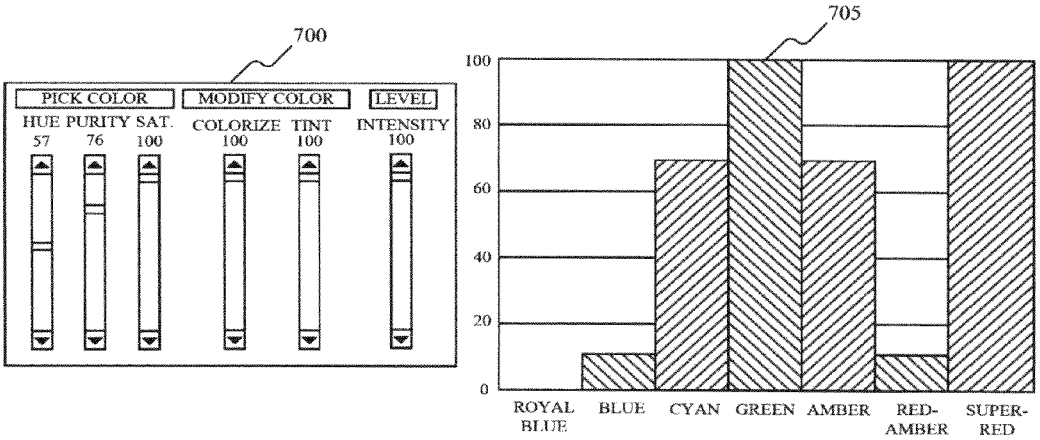
Figure 57:
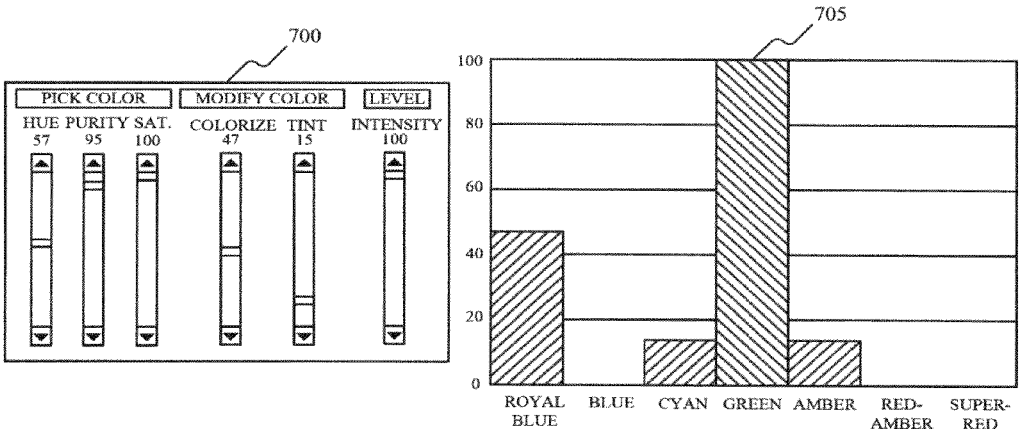
FIGS. 57-62 illustrate a control set and the effect of saturation control on the outputs of the light sources within a multiple light source luminaire.
Figure 58:
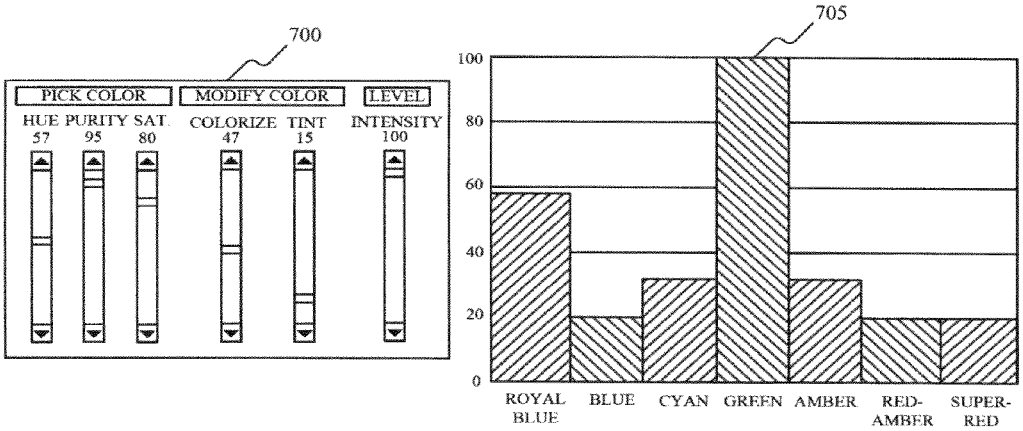
Figure 59:
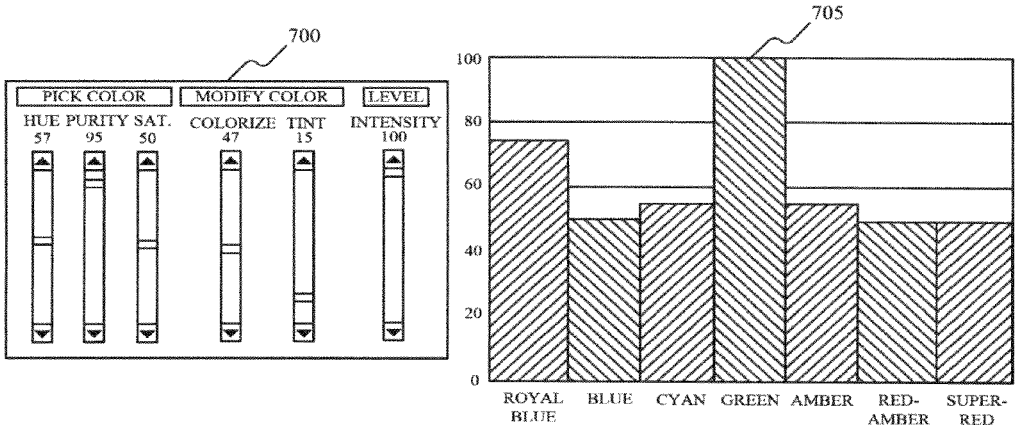
Figure 60:
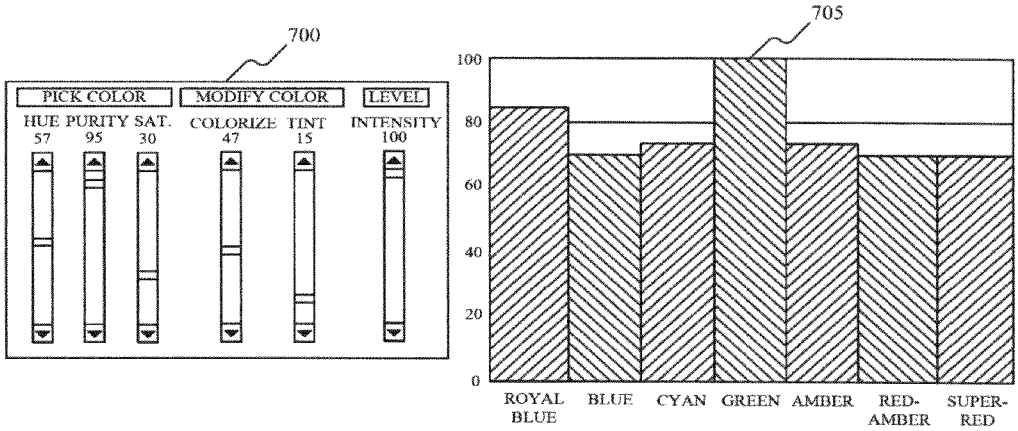
Figure 61:
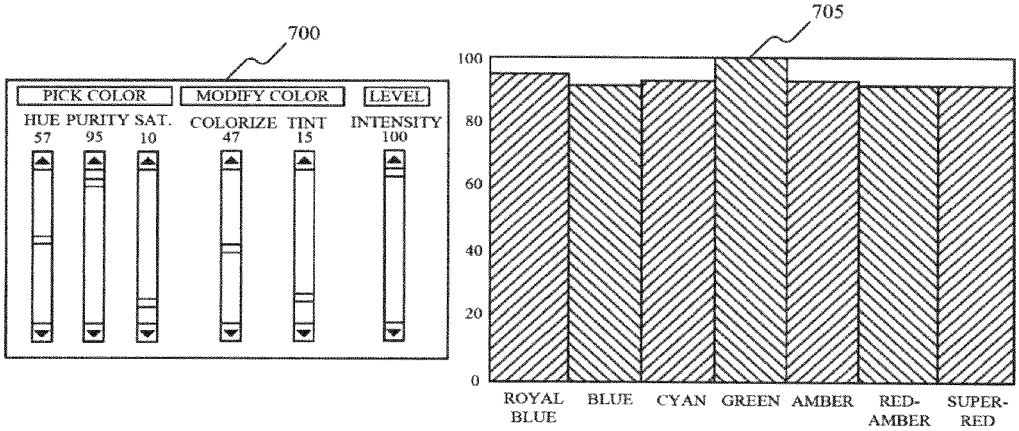
Figure 62:
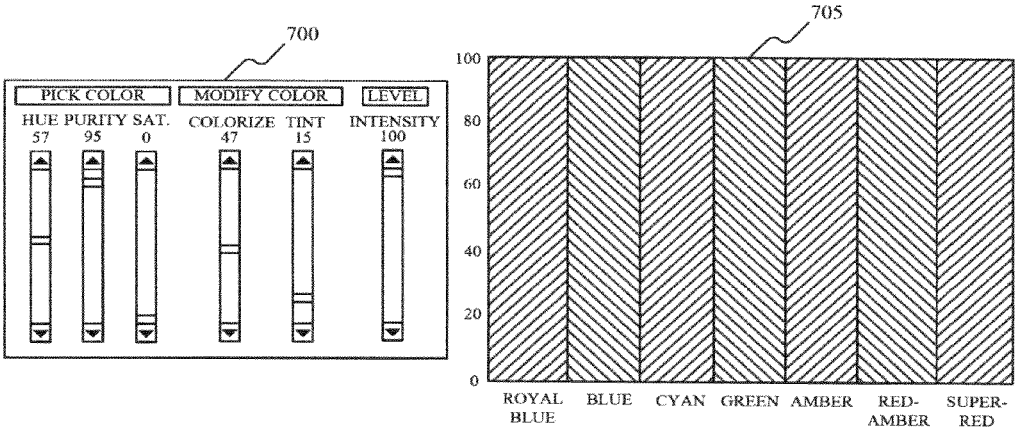

FIGS. 32A-32D illustrate control sets according to various embodiments of the invention. Each sequence of steps is identified using reference numerals 600-615 to identify an order in which steps are generally performed. Letters A-D are used to distinguish steps in different embodiments of the invention. FIG. 32A illustrates a control set in which hue and purity are controlled (step 600A), then saturation is controlled (step 605A), and finally tint and colorize are controlled (step 610A) before a final color spectrum is output (step 615A). FIG. 32B illustrates a control set in which hue and purity are controlled (step 600B), then tint and colorize are controlled (step 605B), and the saturation is controlled (step 610C) before a final color spectrum is output (step 615B). FIG. 32C illustrates a control set in which hue and purity are controlled (step 600C), then tint and colorize are controlled (step 605C), and the saturation is controlled (step 610C) before a final color spectrum is output (step 615C). However, in FIG. 32C, the hue and tint control values are locked such that the hue and tint control values are changed in unison when either of the two control values is modified (described in greater detail below). The control set illustrated in FIG. 32D includes two separate hue and purity controls (step 600D) which can be selected before saturation is controlled (step 605D) and the resultant color spectrum is output (step 610D). FIGS. 32A-32D illustrate only some of the possible control processes which utilize the described system and method for controlling the color output of a lighting system or luminaire.

In a practical implementation of the above-described control method, control of the output color spectrum by the hue, purity, tint, saturation, and colorize controls is adjusted to correspond to the set of available light sources or actual emitters. The light sources are arranged side-by-side spectrally (i.e., according to wavelength). Colors for which no actual emitters are available are generated as a proportional combination of available emitters. For example, if a yellow light source is not available, a yellow output is generated using red or amber in combination with green.

The embodiments of the control set described below include seven emitters, although the method can be applied to any lighting system with multiple light sources. The seven emitters in the described embodiments are: royal blue, blue, cyan, green, amber, red-amber, and super-red. The tables described above with respect to hue and tint control correspond to respective tables for each of the seven emitters (e.g., a blue table, a green table, a red table, etc.). The tables are used to retrieve the required intensity values for each emitter based on a selected hue, purity, tint, saturation, and colorize control values. Additionally or alternatively, the range of wavelengths or wavelength values selected using the hue, purity, saturation, tint, and colorize controls are included in a process which defines a spectral response. The spectral response is then converted to the required drive levels for each of the available light sources.

The effects of the hue, purity, saturation, tint, and colorize controls described above are now shown and described with respect to a single embodiment of the control set 700 including a plurality of control devices, and the effects each control has on the outputs 705 (e.g., output intensity values) of individual light sources. With respect to purity control, the variable slope purity control technique described above with respect to FIGS. 12-17 is used. In the illustrated embodiments, each graph of light source outputs is adjusted such that it creates the perception of constant brightness. In some embodiments, the output intensity values for each of the light sources is proportionally calculated based on the spectral distance of the light source from a selected hue and purity.

FIGS. 33-42 illustrate the effect modifying the hue control has on the respective outputs of the seven emitters. When the hue control is set to zero, the super-red emitter is set at a maximum value and no other emitters provide outputs. As the hue control value is gradually increased, the outputs of the emitters are increased and decreased in a sweeping manner from the left to the right. For example, when the hue control value is set at half of its maximum value or 50%, the cyan and green emitters are each at their maximum outputs. When the hue control value is set to 60%, the green emitter remains at a full output, but the amber emitter is proportionally set to approximately 30% output. Although the illustrated hue control is generally incremented by 10%, precision levels of 1.0% can be achieved using the illustrated embodiments. Additionally, in other embodiments of the invention, the more robust the tables of hue values are, the greater the achievable control precision becomes. For example, precision values of 0.01% or better are achieved in some embodiments of the invention.

FIGS. 43-50 illustrate the effect modifying the purity control has on the respective outputs of the emitters. For illustrative purposes, a hue control value of 57%, which corresponds to a maximum output of the green emitter and minimum outputs of the remaining emitters when the purity control value is set to 100%, is selected. As the purity of the selected hue is decreased, increasing proportions of the adjacent cyan and amber emitters are included in the output. Then, after the purity has been reduced to, for example, 80%, the outputs of the blue and red-amber emitters, which are adjacent to the cyan and amber emitters, respectively, are gradually increased. The purity of the selected hue continues to be decreased to a minimum value or 0.0%, at which time the output of each emitter is at a maximum value for the selected hue and purity control values.

FIGS. 51-56 illustrate the effect modifying the tint and colorize control have on the outputs of the emitters. For illustrative purposes, the hue and purity control values are held constant at 57% and 76%, respectively, while the tint and colorize control values are modified. The tint control value is set at 100%, which corresponds to the super-red emitter. As the colorize control value is gradually increased from a minimum value to a maximum value, the intensity of the output of the super-red emitter gradually increases. The outputs of the other emitters remain at the values corresponding to the selected hue and purity control values.

The effect modifying the saturation control value has on each of the emitter outputs is illustrated in FIGS. 57-62. For illustrative purposes, the hue, purity, colorize, and tint control values are held constant as the saturation control value is changed. The hue control value corresponds to a maximum output of the green emitter, and the purity control value introduces proportional values of the cyan and amber emitters to the overall output. A tint control value of 15% corresponds to the royal blue emitter, and the colorize control value for the royal blue emitter is set to 47%. As the saturation of the selected hue, purity, colorize, and tint controls is gradually reduced, the outputs of each of the emitters is proportionally increased until each emitter is at a maximum value, and the overall output of the lighting system is white. In some embodiments, saturation control is only applied to the selected hue and purity control values, and is adjusted before the colorize or tint control values are modified.

The above described system and method for controlling the output of a plurality of light sources and the corresponding control sets are implemented in a variety of practical applications. Some such applications are provided below.

Figure 63:
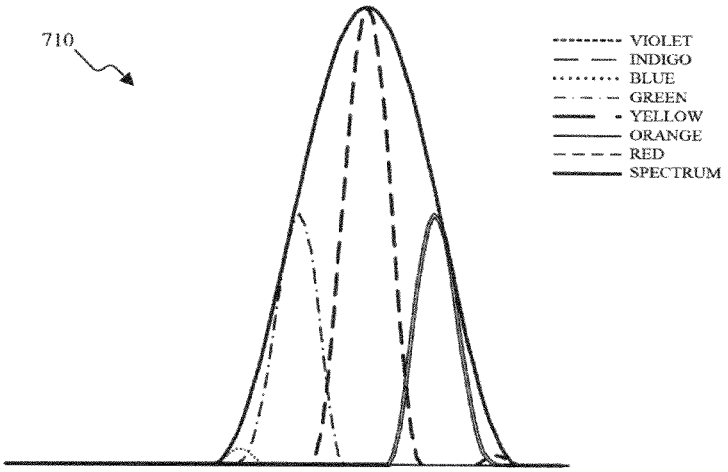
FIG. 63 illustrates a combination of wavelengths to generate wide-gamut yellow according to an embodiment of the invention.
Figure 64:
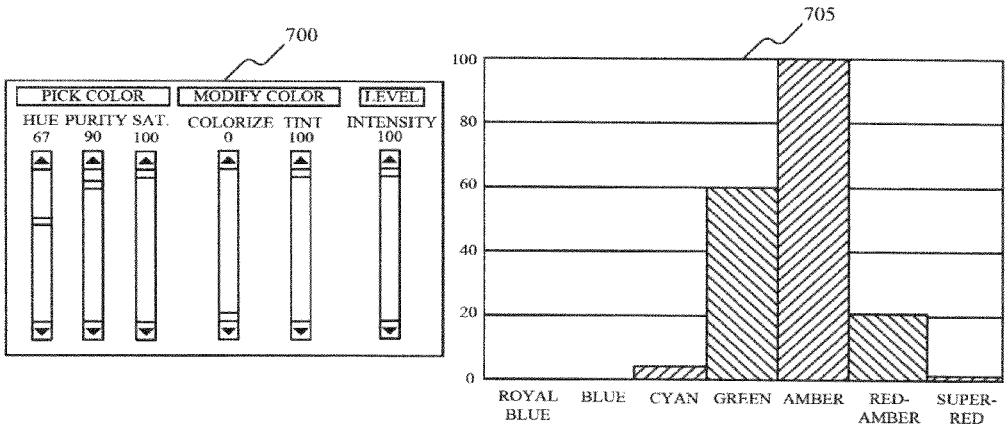
FIG. 64 illustrates a control set and the outputs of the light sources within a multiple light source luminaire for generating wide-gamut yellow.
Figure 65:
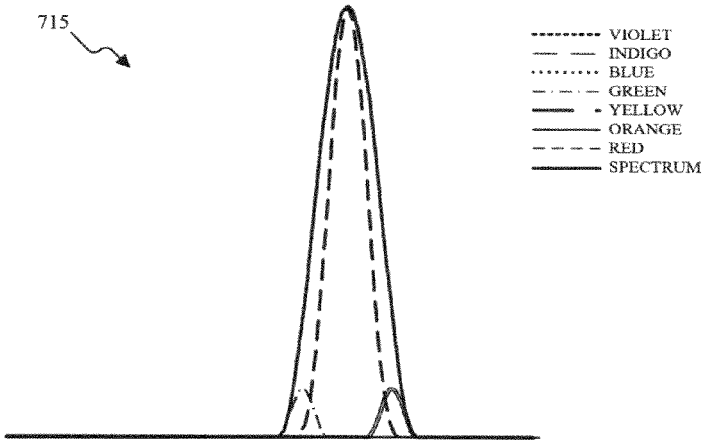
FIG. 65 illustrates a combination of wavelengths to generate narrow-gamut yellow according to an embodiment of the invention.
Figure 66:
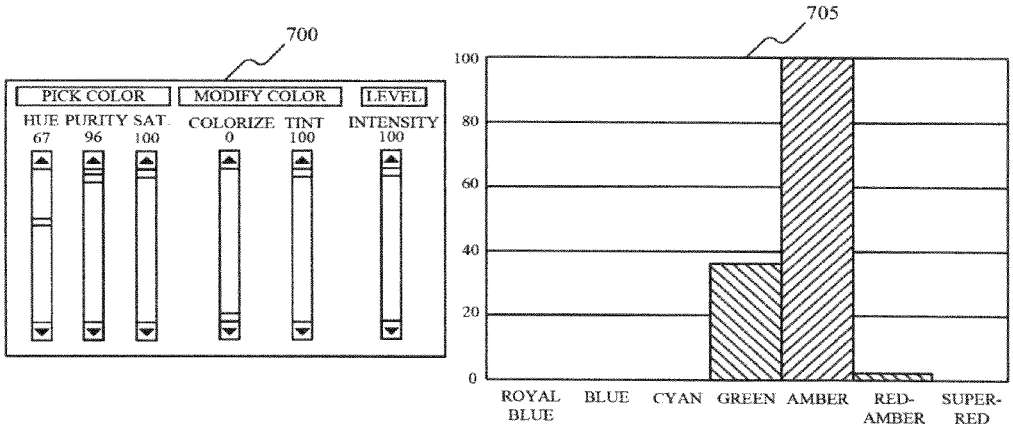
FIG. 66 illustrates a control set and the outputs of the light sources within a multiple light source luminaire for generating narrow-gamut yellow.

The purity control is particularly advantageous when the gamut of a color is to be modified. For example, FIG. 63 illustrates a diagram 710 of wide-gamut yellow. In terms of standard colors, wide-gamut yellow is centered at yellow and includes substantial proportions of both orange and green, as well as smaller proportions of red and blue. Using conventional control techniques, such a combination of wavelengths is difficult or impossible to achieve. However, using the control set described above, wide-gamut yellow is relatively easy to generate using a complex seven light source system. An example of a control set 700 which produces wide-gamut yellow, and the corresponding light source outputs 705 are illustrated in FIG. 64. Similarly, FIG. 65 illustrates a diagram 715 of narrow-gamut yellow in terms of standard colors, and FIG. 66 illustrates a control set 700 and light source outputs 705 for a seven light source system.

Figure 67:
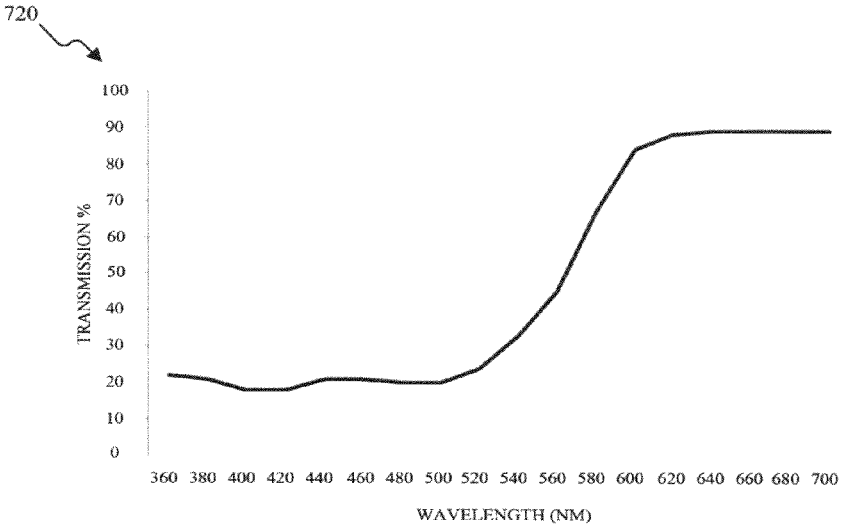
FIG. 67 illustrates a spectrum of light transmission through a filter gel.
Figure 68:
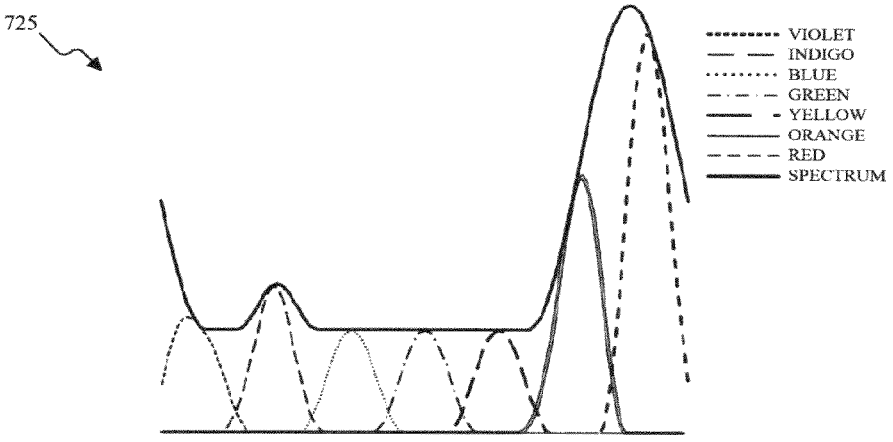
FIG. 68 illustrates a simulation of the spectrum of FIG. 67.
Figure 69:
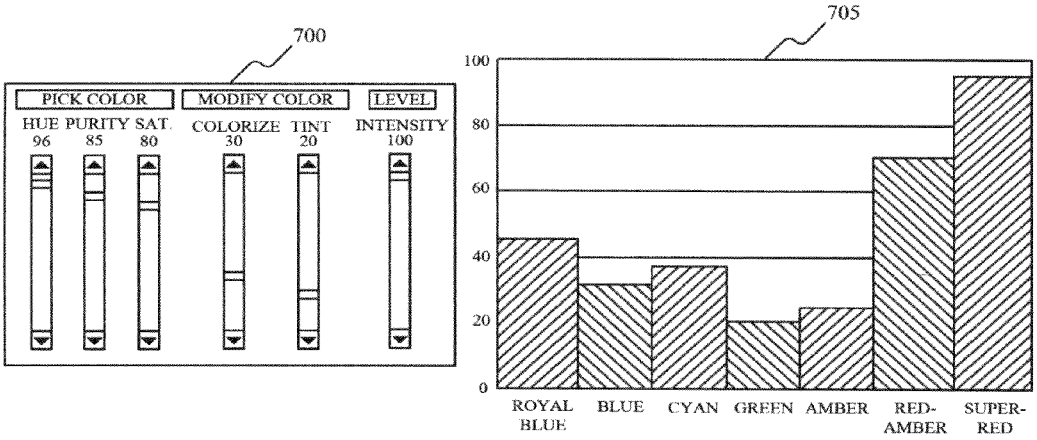
FIG. 69 illustrates a control set and the outputs of the light sources within a multiple light source luminaire for generating the spectrum of FIG. 67.

In one implementation, the control set is used to generate a spectrum which corresponds to a real lighting gel. In many instances, a real lighting gel has several peaks and valleys in its response across the visible spectrum, as illustrated in diagram 720 of FIG. 67. Conventional control techniques, such as the HSI control technique, are unable to accurately reproduce the response of the real lighting gel. An example simulated response of such a lighting gel with respect to the standard colors is illustrated in diagram 725 of FIG. 68. A control set 700 and the corresponding light source outputs 705 which approximately correspond to the response in FIG. 68 is illustrated in FIG. 69.

In another implementation, the system and method for controlling the output of a plurality of light sources are used to generate varieties of white which behave differently depending on the color of a background. The color white is perceived by the human brain when a wide range of wavelengths of light are present (e.g., in the output of a luminaire). Using conventional techniques, red, green, and blue are used to create the perception of what appears to be white light, but is far from an ideal white light output. The quality of the white light generated is dependent upon the width or gamut of the spectrum used, the evenness of the spectrum, and the presence of, the absence of, and the relative intensities of particular frequencies.

The human brain's perception of the color white is also affected by other colors in an observer's field of vision, and to an extent, the age and the state of mind of the observer. In fact, as the methods of measuring the response of the human eye have evolved, so have the measurement systems used to measure the resultant perceived color. The CIE 1931, CIE 1960 and CIE 1976 systems each define a slightly different ratio of component colors for generating white. These systems have, in turn, led to the creation of different definitions of white by the television industry, the film processing industry, and the color printing industry. As such, there is no absolute definition of the color white. Additionally, daylight, which is generally considered to be white light, does not have a fixed degree of whiteness. Instead, it continuously changes based on the time of day, the season, latitude, atmospheric pollutants, and the like. Accordingly, any color manipulation system must define which of the various definitions of, or techniques for generating, the color white will be used, or the system must be able to produce them all.

Figure 70:
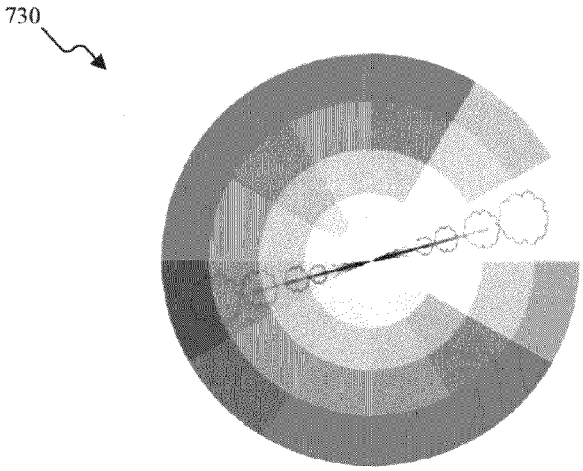
FIG. 70 illustrates the creation of variable de-saturated metamers centered at white, according to an embodiment of the invention.
Figure 71:
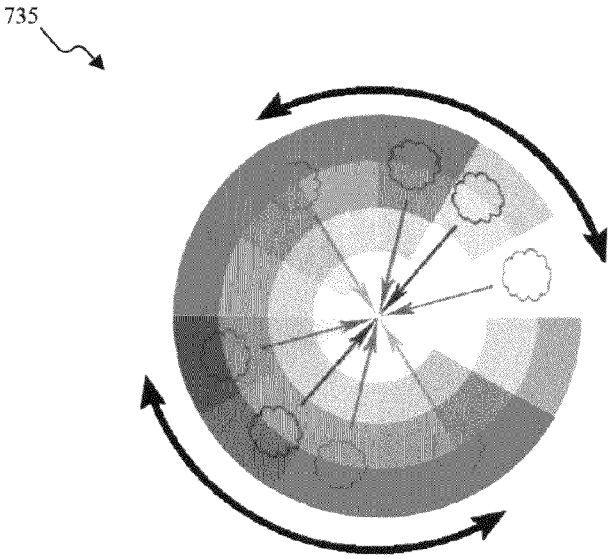
FIG. 71 illustrates the creation of variable de-saturated metamers centered at white, according to another embodiment of the invention.

Two techniques for generating the color white and variable de-saturated white metamers are illustrated in FIGS. 70 and 71. FIG. 70 illustrates a variant 730 of white generation which mixes the opposing colors blue and yellow (i.e., as shown in the illustrated color wheel). FIG. 71 illustrates a variant 735 of white generation which mixes the opposing colors red and cyan. Each of the variants of white may appear to be substantially white on a background which has a constant reflectance at all frequencies (i.e., the formal definition of a white background), but will appear very different on colored backgrounds.

In such embodiments, the tint control is locked to the hue control as described above with respect to FIG. 32C, such that as the hue control value is modified, the tint control value tracks the hue control value at a predetermined spectral distance. If the tint control value is locked to a complementary color the hue control value, an array of additional white metamers can be generated and controlled using a single control. As the hue control value is modified, the tint control value is modified in unison and remains at the predetermined spectral distance to produce another white metamer. Such a control technique provides a simple method of tuning a given white light output to a specific colored background, while the perception of the output remains white.

Figure 72:
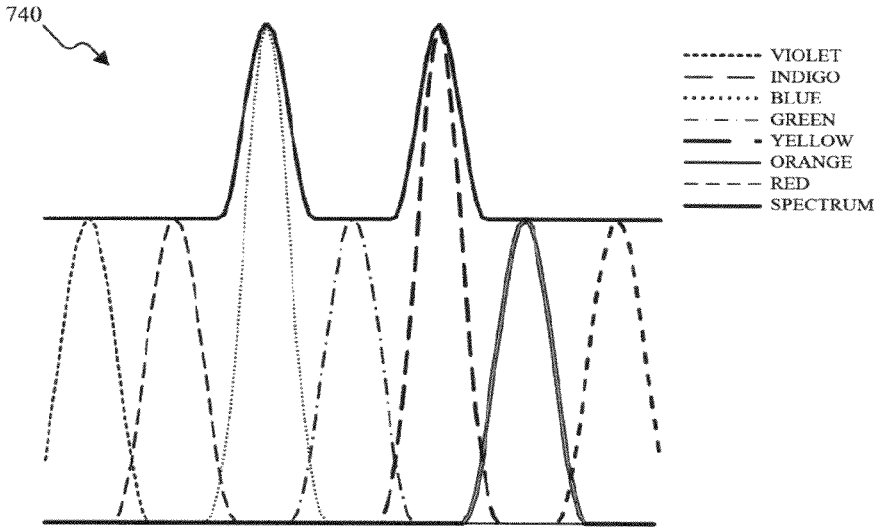
FIG. 72 illustrates a synthesis of white metamers according to an embodiment of the invention.
Figure 73:
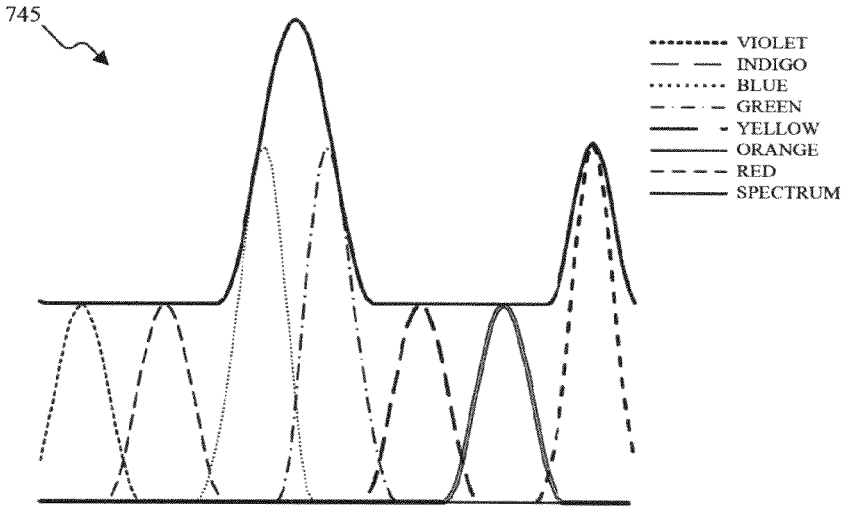
FIG. 73 illustrates a synthesis of white metamers according to another embodiment of the invention.
Figure 74:
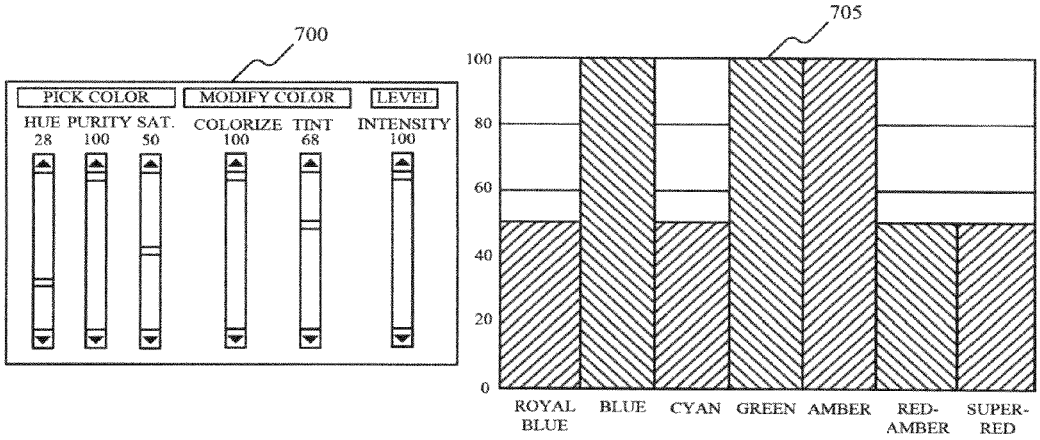
FIG. 74 illustrates a control set and the outputs of the light sources within a multiple light source luminaire for generating the white metamer of FIG. 72.
Figure 75:
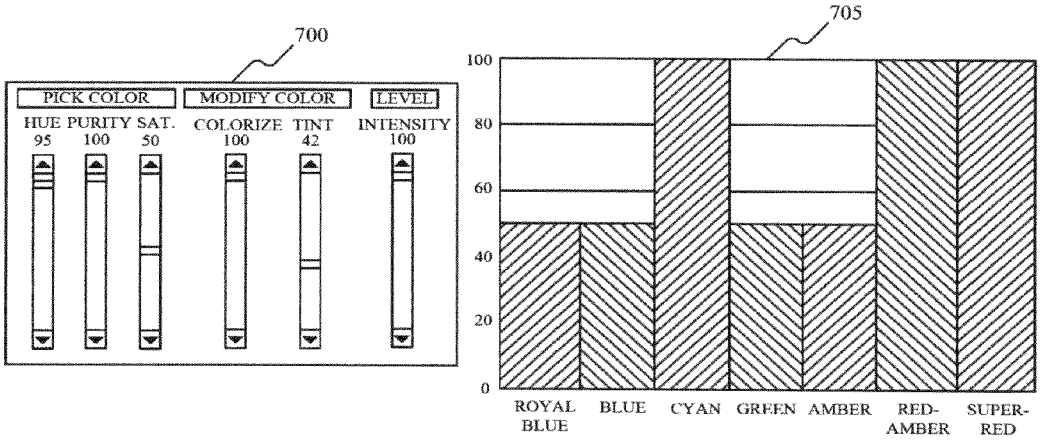
FIG. 75 illustrates a control set and the outputs of the light sources within a multiple light source luminaire for generating the white metamer of FIG. 73.

FIGS. 72 and 73 illustrate the synthesis of the white metamers of FIGS. 70 and 71, respectively. Diagram 740 of FIG. 72 shows the peaks of the standard colors centered at yellow and blue and a relatively high intensity of the remaining standard colors which, when combined, produce a variant of the color white. Similarly, diagram 745 of FIG. 73 shows the peaks of the standard colors centered at red and a combination of green and blue (i.e. cyan). Control sets 700 and light source outputs 705 which can be used to generate the white metamers shown in FIGS. 72 and 73 are illustrated in FIGS. 74 and 75, respectively.

Figure 76:
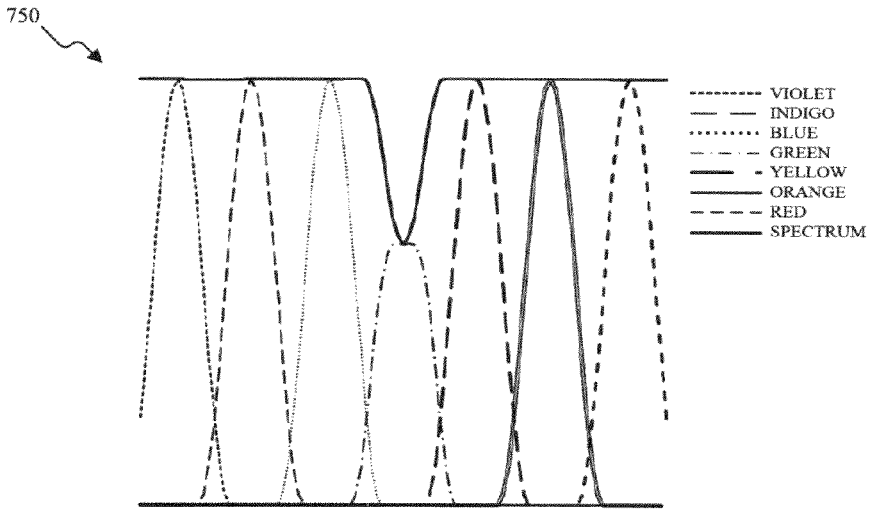
FIG. 76 illustrates the use of the colorize control to remove a color from a spectrum of colors according to an embodiment of the invention.
Figure 77:
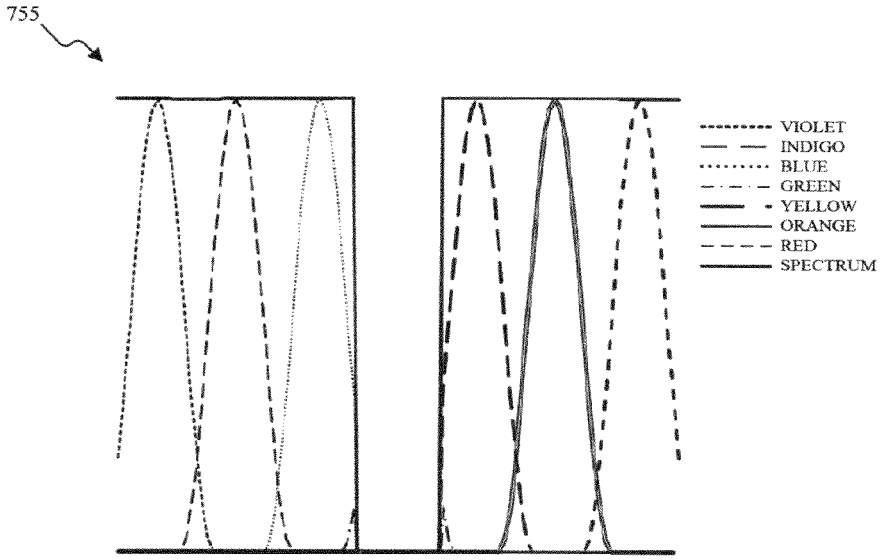
FIG. 77 illustrates the use of the colorize control to remove a color from a spectrum of colors according to another embodiment of the invention.

In some embodiments, the system and method for controlling a plurality of light sources are used to remove a color from a spectrum of colors using the colorize control, as illustrated in FIGS. 76 and 77. In such embodiments, the colorize control is allowed to add or remove a color, and is available before and after the saturation control. If the colorize control is applied after the saturation control and is allowed to remove a color, the control set is able to produce a pastel shade having a missing color band. As an illustrative example, partially removing green from a white light output results in a pink output, as illustrated in diagram 750 of FIG. 76, which has different metamerism properties than a pink which is produced by using a partially saturated red hue. As a second illustrative example, the color green is completely removed from the white light output, as illustrated in diagram 755 of FIG. 77, which, in turn, has different metamerism properties than the pink generated in FIG. 76.

Thus, the invention provides, among other things, a system, a method, and a control set for controlling the outputs of a plurality of light sources by selecting a hue and modifying the purity of the selected hue. Various features and advantages of the invention are set forth in the following claims.

What is claimed is:

1. A system for controlling an output of one or more luminaires, the system comprising:

a plurality of light sources electrically coupled to the one or more luminaires and configured to generate a color output of the system, each of the plurality of light sources having an output intensity value;

a purity input control device operable for setting a purity value associated with a purity of the color output of the system; and a controller connected to the plurality of light sources and configured to select a first hue related to a first range of wavelengths of light and corresponding to an output intensity value for at least one of the plurality of light sources;

modify a purity of the first hue based on the purity value associated with the purity of the output of the color system to modify the wavelengths of light included in the first range of wavelengths, wherein modifying the purity of the first hue modifies an output intensity value of one or more of the plurality of light sources; and control the color output of the system based at least in part on the selected first hue and the purity of the first hue.

2. The system of claim 1, wherein the controller is further configured to modify a saturation of the color output of the system.

3. The system of claim 1, wherein the plurality of light sources includes four or more light sources.

4. The system of claim 1, wherein modifying the purity of the first hue includes modifying a bandwidth of the first range of wavelengths.

5. The system of claim 4, wherein the controller is further configured to select the output intensity value for each of the plurality of light sources based at least in part on the bandwidth of the first range of wavelengths.

6. The system of claim 1, the controller further configured to select a second hue related to a second range of wavelengths.

7. The system of claim 6, wherein an output intensity value for at least one of the plurality of light sources is modified based at least in part on the second range of wavelengths.

8. The system of claim 6, wherein the controller is further configured to modify a purity of the second hue to modify the wavelengths of light included in the second range of wavelengths.

9. A method of controlling an output of one or more luminaires, each of the one or more luminaires including a plurality of light sources, the method comprising:

generating a color output;

associating an output intensity value with each of the plurality of light sources;

selecting a first hue related to a first range of wavelengths of light and corresponding to the output intensity value for at least one of the plurality of light sources; and modifying a purity of the first hue to modify the wavelengths of light included in the first range of wavelengths, wherein modifying the purity of the first hue modifies an output intensity value of one or more of the plurality of light sources and the color output.

10. The system of claim 9, further comprising modifying a saturation of the color output.

11. The system of claim 9, wherein the plurality of light sources includes four or more light sources.

12. The system of claim 9, wherein the modifying the purity of the first hue includes modifying a bandwidth of the first range of wavelengths.

13. The system of claim 12, further comprising selecting an output intensity value for each of the plurality of light sources based at least in part on the bandwidth of the first range of wavelengths.

14. The system of claim 9, further comprising selecting a second hue related to a second range of wavelengths.

15. The system of clam 14, further comprising modifying an output intensity value for at least one of the plurality of light sources based at least in part on the second range of wavelengths.

16. The system of claim 14, further comprising modifying a purity of the second hue to modify the wavelengths of light included in the second range of wavelengths.

17. A control set for controlling an output of one or more color sources, each of the one or more color sources having an output intensity value, the control set comprising:

a first output control device configured to select a first hue related to a first range of wavelengths in the visual spectrum, the selected first hue corresponding to an output intensity value for at least one of the one or more color sources; and a purity control device configured to modify a purity of the first hue to control the wavelengths of light included in the first range of wavelengths, wherein the purity control device modifies an output intensity value of one or more of the one or more color sources.

18. The control set of claim 17, further comprising a third output control device configured to select a second hue related to a second range of wavelengths.

19. The control set of claim 18, wherein an output intensity value for at least one of the one or more color sources is modified based at least in part on the second range of wavelengths.

20. The control set of claim 17, further comprising a fourth output control device configured to modify a saturation of the one or more color sources.

21. A method of controlling an output of one or more luminaires, each of the one or more luminaires including a plurality of light sources, the method comprising:

generating a color output;

associating an output intensity value with each of the plurality of light sources; and selecting a hue related to a range of wavelengths of light and corresponding to an output intensity value for each of the plurality of light sources, wherein the output intensity values required to generate the color output are divided among the plurality of light sources, and the output intensity values of the light sources are proportional to the spectral distance of the light source from the range of wavelengths.

* * * * *